US007051658B2

(12) United States Patent
Fahrni et al.

(10) Patent No.: US 7,051,658 B2
(45) Date of Patent: May 30, 2006

(54) TEMPERATURE-INDEPENDENT PROPELLANT POWDER

(75) Inventors: Markus Fahrni, Längenbühl (CH); Beat Vogelsanger, Thun (CH); Alfred Steinmann, Praroman (CH); Bruno Ossola, Faulensee (CH); Ulrike Jeck-Prosch, Mühldorf (DE); Alexander Huber, Bruckmühl (DE); Kurt Ryf, Wimmis (CH)

(73) Assignees: Nitrochemie Wimmis AG, Wimmis (CH); Nitrochemie Aschau GmbH, Aschau am Inn (DE)

( * ) Notice: Subject to any disclaimer, the term of this patent is extended or adjusted under 35 U.S.C. 154(b) by 0 days.

(21) Appl. No.: 10/096,111

(22) Filed: Mar. 13, 2002

(65) Prior Publication Data

US 2002/0134269 A1 Sep. 26, 2002

(30) Foreign Application Priority Data

Mar. 13, 2001 (EP) ..... 01810255

(51) Int. Cl.
*C06B 45/00* (2006.01)

(52) U.S. Cl. ..... 102/292; 149/19.4

(58) Field of Classification Search ..... 102/289, 102/290, 292; 427/212; 149/19.4
See application file for complete search history.

(56) References Cited

U.S. PATENT DOCUMENTS

| | | | | |
|---|---|---|---|---|
| 2,771,351 A | | 11/1956 | Holmes et al. | |
| 3,506,505 A | | 4/1970 | Herzog et al. | 149/11 |
| 4,597,994 A | | 7/1986 | Bolinder et al. | 427/213 |
| 4,627,352 A | * | 12/1986 | Brachert et al. | 102/290 |
| 5,682,009 A | | 10/1997 | O'Meara et al. | |
| 2003/0129304 A1 | * | 7/2003 | Jeck-Prosch et al. | 427/212 |

FOREIGN PATENT DOCUMENTS

| | | | |
|---|---|---|---|
| DE | 30 08 196 | 9/1981 | |
| DE | 25 20 882 | 7/1986 | |
| EP | 0 290 718 | 11/1988 | |
| EP | 0290718 | 1/1990 | |
| EP | 1 031 548 | 8/2000 | 427/212 |
| GB | 508914 | 7/1939 | |

* cited by examiner

*Primary Examiner*—Aileen Felton
(74) *Attorney, Agent, or Firm*—Venable LLP; Marina V. Schneller

(57) ABSTRACT

The proposed propellant powder exhibits a temperature-independent burning behavior and high ballistic stability. The production process starts with a perforated bulk powder grain, which is processed inside a mixing apparatus with a solid material, a plug-stabilizing moderator or deterrent (if necessary also a radical initiator) and a low-viscous liquid. With a minimum amount of solid material, moderator or deterrent and liquid and because of the continuous mixing, the form function is influenced in such a way that the gas-formation rate is practically independent of the propellant powder temperature. As a result, the muzzle energy at the normal temperature and, above all, at a low deployment temperature can be increased markedly as compared to that of a standard propellant powder.

Figure 1A:
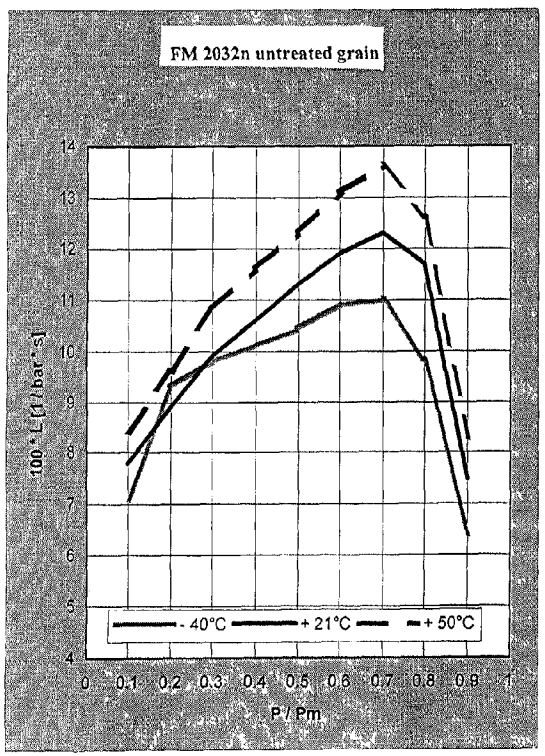

le;.5qWith the propellant powder according to the invention, for which the grain has at least one perforation that discharges with an opening to the outside surface of the grain, wherein the opening is closed off with a plug, the plug has a temperature-dependent mobility. As a result, the plug has a higher mobility for a lower deployment temperature than for a higher deployment temperature, so that the plug permits a faster hole burning at a lower deployment temperature than at a higher deployment temperature.

21 Claims, 11 Drawing Sheets

- 40°C

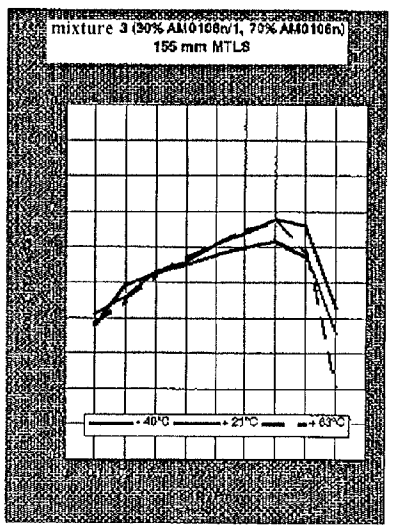
Fig. 9d
Fig. 9b
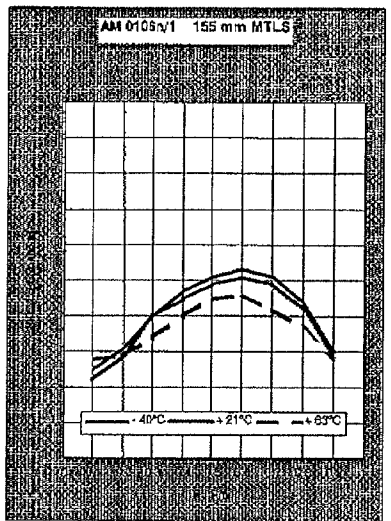
4 weeks
63°C
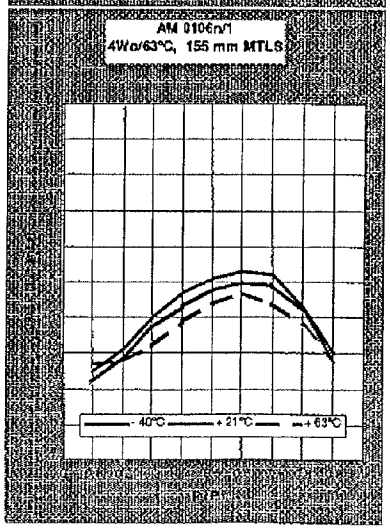
Fig. 9c
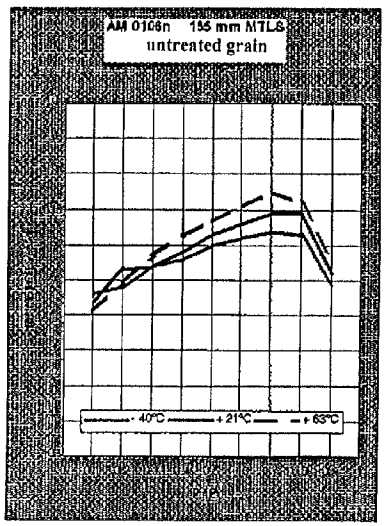
Fig. 9a

TEMPERATURE-INDEPENDENT PROPELLANT POWDER

TECHNICAL FIELD

The invention relates to a propellant powder, for which the grain has at least one perforation that discharges with an opening to the outside surface of the grain, wherein this opening is closed off with a plug. The invention furthermore relates to a method for producing a propellant powder of this type.

PRIOR ART

Propellant powders (TLP) for conventional barrel weapon systems should be configured such that they can function safely and without problems under different environmental conditions (system-specific factors). Great temperature differences during the weapon deployment represent one of the most important influences, which a propellant or ammunition manufacturer must take into consideration. Thus, local and/or global climactic conditions may require secure propulsion solutions for a temperature range of between −54° C. and +63° C./+71° C. (and up to +100° C. for the deployment from an aircraft).

Since propellant powders naturally burn temperature-dependent (based on the laws of physics), considerable pressure differences normally occur during the firing of weapons in the aforementioned temperature range.

For all weapon systems as well as barrel weapons, there is a constant demand for performance increases (e.g. higher kinetic energy for the tank-fired projectile, longer ranges for artillery shells, shorter flight times for anti-aircraft projectiles [machine gun], higher first-hit probability, etc.).

Performance increases that must be realized with new developments are extremely cost-intensive.

For cost reasons, interest is high in the field of weapon technology to achieve the desired performance increases with previously introduced, existing weapons platforms (increase in combat effectiveness).

The desired performance increases can be achieved only through utilizing all reserves and a combination of suitable measures (optimizing of internal ballistic actions), wherein the basic weapon-technological requirements remain unchanged.

These measures include:

- Achieving a higher efficiency of the basic propellant powder formulation by using formulations with a high force (specific energy or propellant force).
- Achieving maximum bulk densities (through high densities or optimum surface properties of the propellant powder) inside the predetermined casing volumes.
- Increasing the progressiveness of the propellant powder burning
- Minimizing or eliminating the dependence of the propellant powder burning rate on the temperature.

The problem with providing these desired new high-performance propellant powders is that undesirable side effects must be avoided. That is to say, the full expanded system compatibility with respect to barrel (erosion, corrosion), weapon (peak gas pressure) and environment (avoiding formulation components that are problematic for the environment) must still be ensured for the demanded, higher performance level.

Finally, it is desirable to produce these demanded high-performance propellant powders cost-effectively, meaning with easy to obtain, cheap starting materials and simple techniques.

According to the laws of physics, the burning speed depends on the spontaneous ignition temperature and the starting temperature of the propellant body. This relationship leads to the well-known characteristic of such traditional propellant powders, meaning that the linear burning speed more or less depends on the starting temperature. From this, it necessarily follows that the peak gas pressure and the muzzle velocity have a more or less steep temperature gradient. The temperature-dependent performance of such propellant powders has considerable disadvantages, for example a low first hit probability and considerably lower projectile energy during the deployment at normal and, above all, at low temperatures. The limiting factor is always the peak gas pressure occurring at high temperatures.

The relevant literature contains few works dealing with the modification of weapon systems or propellant powders, which modification results in uniform, temperature-independent performances.

Thus, a surface coating is disclosed in U.S. Pat. No. 4,106,960, for which a three-base 19-hole propellant powder is coated during 20 depositing and drying cycles with 18% polymethylmethacrylate (mol weight >100'000), 3.4% titanium oxide, 1.9% diphenyl-cresylphosphate and 100% toluene (all percentages relative to the propellant powder). The propellant powder is preferably coated with approximately 10 to 20 weight shares (relative to the propellant powder amount) of inert material. This corresponds to an inert cover layer of 100 to 200 microns. As a result, the propellant powder ignition is delayed considerably. The temperature dependence of the propellant powder can be inverted if this highly treated propellant powder is mixed with an untreated propellant powder having a non-delayed ignition. A mixture of treated grain and untreated grain tested in the pressure bomb (where all material burns up) showed a temperature-independent behavior, wherein the burning time was not specified. The temperature-independent behavior was not tested in a weapon firing.

An article providing an overview by D. L. Kruczynski, J. R. Hewitt, "Technical Report BRL-TR-3283 (1991), mentions temperature-compensation techniques and technologies where deterrents are said to exert a certain influence on the reduction of the temperature coefficient. However, the mechanism for this appears to be unclear so far. Furthermore suggested is the production of a propellant powder, which utilizes the brittle fracture (surface area enlargement) at low firing temperatures for an increase in the vivacity and the compression of the soft grain and thus the holes (decreasing the surface area) at high firing temperatures for a reduction in the vivacity. Processes of this type, however, are hard to control and contain an immense safety risk.

Another suggestion for reducing the temperature dependence relates to adapting the cartridge chamber volume in dependence on the propellant powder temperature.

A different publication that also deals with the reduction in the temperature sensitivity of propellant powders, used in particular for artillery weapons, and uses similar arguments is by T. T. Nguyen, R. J. Spear, Department of Defense, Australia, DSTO-TR-0102 (1994). It is noted in this publication that no additive could be found to reduce the temperature dependence of the propellant powder combustion.

REPRESENTATION OF THE INVENTION

It is the object of the invention to specify a propellant powder of the aforementioned type, which exhibits a mostly temperature-independent burning without resulting in noticeable losses of other characteristics. In particular, this should not result in a worsening of the ignition behavior or the chemical and ballistic stability of the propellant powder.

This object is solved with the features in claim 1. According to the invention, áa propellant powder of the aforementioned type is distinguished by the temperature-dependent mobility of the plugs, which results in a higher mobility at a lower deployment temperature than at a higher deployment temperature. Thus, with a lower deployment temperature, the plugs permit a stronger hole burning than at a higher deployment temperature.

Plugs are formed inside the perforation tunnels with the aid of a suitable surface treatment of perforated propellant grains. As a result, the propellant grains processed in this way burn practically independent of the propellant powder temperature. A behavior of this type is referred to as SCDB®[1] effect.

[1] Translator's Note: SCDB stands for surface coated double base

The above effect is based on the temperature-dependent plug mobility during the propellant powder ignition operation. If the propellant powder temperature is high (resulting in a fast burning speed), the plugs remain inside the perforation tunnels and a minimum surface is available for the burning. With a low temperature (slow burning speed), the plugs are all removed by the ignition pressure wave and a maximum surface area is available for the burning. Ideally, the product of burning speed times the surface is constant for all firing temperatures, which equals a temperature-independent burning.

The temperature-dependent plug mobility is controlled by fine-tuning the relevant parameters during the surface treatment and by the temperature-dependent expansion of the propellant grain matrix or the plug. Two important parameters in this connection are the amount of graphite used and the treatment time. The longer the treatment, the stronger the plugs. It must be taken into consideration here that the introduction of graphite alone will not generate the effect according to the invention. The graphite must also be compacted or glued together to form a type of rigid body, wherein solvents and deterrents are used for this. (If the grain is soft, for example, a deterrent can also be omitted.)

In general, it is true that adhesion (tackyness) of organic materials above their glass transition point increase with increasing temperature. The glass transition for two-base and multi-base nitrocellulose is around −40° C.

Therefore the propellant grains and also the plugs (with the inorganic solid material being glued together with small amounts of blasting oil, deterrent and nitrocellulose) exhibit a higher adhesive behavior at high temperatures. The plugs thus can hardly be displaced by the pressure wave during ignition.

With increased burning (around the plugs) the plugs are gradually forced into the perforations by the enormous gas pressure.

At −40° C. the glueing effect of the plugs and the nitrocellulose matrix are strongly reduced. Consequently the shock wave drives the plugs immediately into the perforation holes andlor pulverizes these since the brittleness especially of the plugs is increased at low temperatures.

Diverse parameters exist for the surface treatment according to the invention (propellant powder composition and amount, amount and grain size of the solid material, polarity and amount of solvent, amount and polarity of deterrent or moderator, treatment length and treatment temperature), which can be varied to adapt the plug mobility. Thus, the mobility steadily decreases from the lowest to the highest firing temperature.

It must be considered that the above-described plug mobility in the perforation tunnels represents a statistic variable. Not every plug reacts in the same way to the ignition pressure wave.

The physical conditions existing with a low deployment temperature ensure that the plugs will be pulled from their positions during the first pressure wave already and thus free the holes. The contact location between plugs and hole wall thus is brittle so-to-speak at low temperature. With a higher temperature, on the other hand, it is tough, so-to-speak, and can better resist the ignition pressure wave. It must be taken into consideration here that "brittleness" or "toughness" of the anchoring refers to statistical parameters. It is not relevant that each plug reacts exactly in the same way to the pressure wave. Rather, it is sufficient if the totality of all plugs for all propellant grains in the ammunition statistically exhibits the same characteristic reaction. Of course, it is necessary to conduct tests within a certain scope to achieve the desired temperature independence for a specific ammunition. Based on the inventive statement on how to select the mobility of the plugs, however, the person skilled in the art can see which optimization should be made in the individual case.

The hole burning characterizes to what degree the combustion processes occurring inside the holes contribute to the gas formation rate. The more holes are released, the more surface area is available for the burning. Accordingly, the grain during each time unit produces more gas.

It must be mentioned here that for the purpose of the present invention, only the compacted and anchored portion of the material inside the hole is understood to be the plug. The relatively loose material underneath the compacted portion of the filling does not function as plug within the meaning of this invention and consequently is not called a plug. It is understood that in practice there is not necessarily a clear boundary delimiting the plug. The plug can also change in a "flowing" manner over to the remaining portion of the filling inside the hole. Insofar as the invention is concerned, however, there is always a section with sufficiently high density, which can resist an ignition pressure wave in a controlled manner.

The invention has diverse advantages as compared to the approaches suggested in prior art. First of all, it must be noted that the invention is basically suitable for double base and multi-base perforated propellant powders deployed in barrel weapons. Propellant powders can thus be produced, which have a temperature-independent burning rate, can be initiated easily with traditional ignition means and additionally have a high ballistic stability (deployment service life). As a result of the temperature independence (more or less uniform gas-formation rate), the propellant powder energy can be used optimally over the complete temperature range.

Tests have shown that by combining the internal ballistic optimization and improvement measures, described in the following, it is possible to achieve a performance increase (muzzle energy) of 10% and more for previously introduced weapon systems.

The plug should consist, if possible, of a substance that is not soluble in the untreated grain (meaning the untreated perforated propellant), thereby ensuring that the anchoring of the plug inside the opening and thus the mobility of the plug cannot change as a result of diffusion processes. The anchoring is therefore essentially determined by the surface parameters in the plane for the grain or plug structure.

The plug preferably consists essentially of an inert solid material. Depending on the propellant powder temperature, the plug is pushed more or less strongly into the perforation hole by the pressure wave resulting from the ignition. The plug displacement increases the active surface and, consequently, also the gas development per unit of time. With a relatively low starting temperature, the plug is quickly released from its anchoring. As a result, the burnable propellant surface is increased all of a sudden, so-to-speak. With a relatively high propellant powder temperature, on the other hand, the anchoring of the plug is quite resistant and the burnable propellant surface is reduced to a minimum.

A solid material with a grain size in the range of 0.01 to 100 micrometers can be used, wherein the grain size should be matched to the diameter of the perforation opening. If the grains of the solid material are relatively large, they can be inserted only with difficulty into the perforation opening. The grain size typically will be in the range of 0.1 to 50 micrometers.

However, the solid material does not have to be inert; it can also contain energy. Of course, it should ignite and burn slower than the untreated grain.

Graphite, talcum, titanium oxide, carbon black, potassium sulfate, potassium cryolite and/or calcium carbonate, for example, are suitable as solid materials. However, other substances that do not react with the untreated grain can be used as well. The aforementioned substances can be used individually as well as in combination.

The invention is not limited to a plug consisting exclusively of inert substances. It is indeed possible to add small amounts of an energetic solid material, in particular nitrocellulose, hexogen, octogen, nitroguanidine, nitrotriazole, ethylene dinitramine, ethyltetryl, ammonium picrate, trinitrotoluene, trinitrobenzene, tetranitroaniline, and the like. These can also include strong oxidants such as ammonium nitrate, potassium nitrate, ammonium perchlorate, potassium perchlorate and the like, provided these are not incompatible with the selected mix. It must be ensured that the stability or resistance of the plugs formed in the openings (perforations) to the ignition impulse wave is not lost at higher propellant powder temperatures.

Compounds with a melting point above approximately 80° C. are suitable energetic solid materials to be mixed in. These solid materials should not have high sensitivity to percussion or friction. A selection of highly explosive substances which thus have only limited suitability are listed in R. Meyer, "EXPLOSIVSTOFFE" [Explosive Materials], Publishing House "CHEMIE" [Chemistry] 1979, page 121 ff.

The plug preferably has a melting temperature that is above the production temperature, storage temperature and/or deployment temperature and, in particular, is above 90° C.

The propellant typically is a double base or multi-base single-hole or multiple-hole propellant. That is to say, the grain is cylindrical (with an external diameter of, for example, 1 mm to 20 mm and preferably 3 mm to 15 mm) and is advantageously provided with 7 to 19 holes extending through in axial direction. The ratio of grain diameter to grain length is normally in the range of 0.3–2.0, preferably 0.8–1.2. The propellant geometry can also be different; for example it can have a rosette shape or a hexagonal shape.

The diameter for the holes is in the range of 0.03 to 0.5 mm, for example, and in particular in the range of 0.1 to 0.3 mm. For the purpose of this invention, smaller holes are advantageous because smaller amounts of inert material can be used in that case. In addition, they allow for a better control of the quality of the plug anchoring. The dense (compacted) plugs typically have a ratio of length to diameter in the range of 5 to 60.

The untreated grain can be produced in a manner known per se by compressing a solvent-containing or solvent-free propellant powder dough or propellant powder pack with or without the additive of blasting oil in an extruder or by means of extrusion.

The perforations closed off by the plugs are axial through tunnels with a perforation volume that is a multiple of a compact plug volume.

In order to produce the temperature-independent burning propellant powder, a solid material is inserted into the openings and is compacted and secured in the form of plugs that have a temperature-dependent mobility. The plugs have a higher mobility (ability to be displaced inside the hole) at a lower deployment temperature than at a higher deployment temperature, so that the plugs permit a faster hole burning at a lower deployment temperature than at a higher temperature.

The solid material is preferably inserted into the opening with the aid of a moderator, in particular a moderator that is not soluble in the grain, and a highly volatile liquid. The complete process occurs inside a mixing apparatus, e.g. a drum. During the rotation, the mixture of moderator, liquid and solid material is pressed successively into the grain holes as a result of the propellant powder mass pressure or the moist mixture works itself into the holes under the effect of the propellant powder mass pressure. It must be noted here that the holes in the propellant fill up relatively quickly and loosely with the dry solid material. However, it is important for the effect according to the invention that a compacted section of solid material is formed at the entrance to the hole, which can withstand the ignition pressure wave under the specifically desired conditions. It has turned out that for the completely treated grain, the solid material density in the holes decreases from the outside toward the inside, wherein the relatively loose mass underneath the compacted plug does not play a critical role in controlling the hole burning.

The untreated grain, the solid material and the moderator are processed together with a liquid inside a mixing apparatus, at a temperature range between 0° C. and 90° C. The treatment duration ranges from 10 minutes to 3 hours, at a rotational speed for the mixing apparatus of between 2 and 30 rotations per minute (rpm).

According to one preferred embodiment, the moderator used can be radically cross-linked. A radical initiator is additionally used for cross-linking the solid material.

The smallest possible amounts of the solid material and the moderator are used in the mixing apparatus, for example 0.001 weight % to 4 weight %, relative to the weight of the untreated grain. The solid material and the moderator are typically added to the mixing apparatus drum in amounts that are noticeably smaller than 1 weight %.

The low-viscous liquid is added to the mixing apparatus in similar amounts: 0.1 weight % to 5 weight %, relative to the weight of the untreated grain. A low-viscous liquid in this connection is a liquid that can be moved easily with the dissolved moderator at room temperature. Low molecular, well-running solvents such as water, alcohol, toluene, cyclohexane, etc. can be used.

A radical initiator can be used, for example in amounts of 0.1 mol % to 5 mol % relative to the mol amount of the cross-linkable moderator, wherein the radical initiator has a high decomposition stability for the surface treatment temperature inside the mixing apparatus. The decomposition time during the surface treatment for half the quantity of the radical initiator, for example, exceeds 10 hours. At the polymerization temperature, on the other hand, the radical initiator must decompose quickly into radicals. In that case, the decomposition time for half the quantity of the radical initiator can be less than 1 hour.

After treating the propellant powder with a cross-linkable moderator and an initiator, atmospheric oxygen must be removed from the propellant powder by flushing it with inert gas or through a vacuum/flushing with inert gas at room temperature.

The cross-linking of the moderator is typically realized with inert gas under normal pressure, at a temperature of less than 90° C. and during a period of less than six times the decomposition half-life of the radical initiator at this temperature.

Polyvinyl alcohol, poly (α-methyl styrene), poly(vinyl alcohol-co-vinyl acetate), poly(vinyl alcohol-co-ethylene), polybutadienediol, polybutadienediol methacrylate, polybutadienediol diacrylate or hydrocarbons with even longer chains, such as waxes, are particularly suitable as moderators that are not cross-linked. These moderators remain in the plug and on the propellant surface because they are not soluble in the propellant powder matrix. No diffusion into the propellant grain or away from the propellant surface occurs.

Water, hexane, cyclohexane, toluene or a mixture of water/ethanol, water/methanol, water/acetone, ethanol/cyclohexane or toluene/hexane can be used as liquid.

The following substances can be used, for example, as cross-linkable moderators: hexanedioldiacrylate, dipropyleneglycoldiacrylate, ethyleneglycoldimethacrylate, tetraethyleneglycoldiacrylate, trimethylolpropanetriacrylate, triethylene glycoldiacrylate, propoxylated glycerin triacrylate, pentaerythritol tetraacrylate, ethoxylated bisphenol A-diacrylate, propoxylated neopentylglycol-diacrylate, ethoxylated neopentyl-glycol-diacrylate, polyethyleneglycoldiacrylate, polybutadienedioldiacrylate, polybutadienedioldimethacrylate, polyethyleneglycoldimethacrylate, polypropylene oxide diacrylate.

The liquid can be removed by allowing it to evaporate from the opened mixing apparatus while the mixture is rotated. The finished propellant is subsequently stored for several days at an elevated temperature (e.g. 3 days at 60° C.) to remove residual solvents and other volatile components.

The perforated propellants can have optional formulations and dimensions. For example, they can be composed of the following energy carriers:

Nitrocellulose with different nitration degrees, polyglycidylnitrate, poly glycidylazide, polyNIMMO, polyAMMO, polyBAMO, ethyleneglycoldinitrate, diethyleneglycoldinitrate, nitroglycerin, butanetrioltrinitrate, metrioltrinitrate, nitroguanidine, hexogen, octogen, alkyl-NENA, CL-20, DNDA57, NTO, PETN, etc.

If necessary, the perforated propellant can contain additives that are known in propellant production for the stabilization, barrel protection, plasticizing and gun flash damping. Known additives for increasing the stabilization are, for example, Acardit II (CAS No: 724-18-5), Centralit I (CAS No. 90-93-7), Centralit II (CAS No.: 611-92-7), 2-nitrodiphenylamine (CAS No.: 836-30-6) and diphenylamine (CAS No.: 122-39-4). Talcum (CAS No.: 14807-96-6), titanium dioxide (CAS No.: 13463-67-7), calcium carbonate (CAS No. 1317-65-3) or magnesium silicate (CAS No.: 14807-96-6) can be used for protecting the barrel while camphor (CAS No.: 76-22-2) or dibutyl phthalate (CAS No.: 84-74-2) can be used for the plasticizing. Potassium sulfate (CAS No.: 7778-80-5) or potassium cryolite, on the other hand, can be used for the gun flash damping. The untreated grain can furthermore contain other additives to improve the ignition behavior and modulate the burning. All the aforementioned additives can be added to the powder dough while preparing the untreated grain and are thus distributed evenly in the grain matrix. The total amount of additives in the untreated grain is between 0–20 weight %, relative to the nitrocellulose content, preferably between 0.1–5 weight %. However, these additives can also be introduced through the surface treatment according to the invention.

Additional advantageous embodiments and feature combinations for the invention follow from the detailed description below and the complete set of patent claims.

SHORT DESCRIPTION OF THE DRAWINGS

Figure 1B:
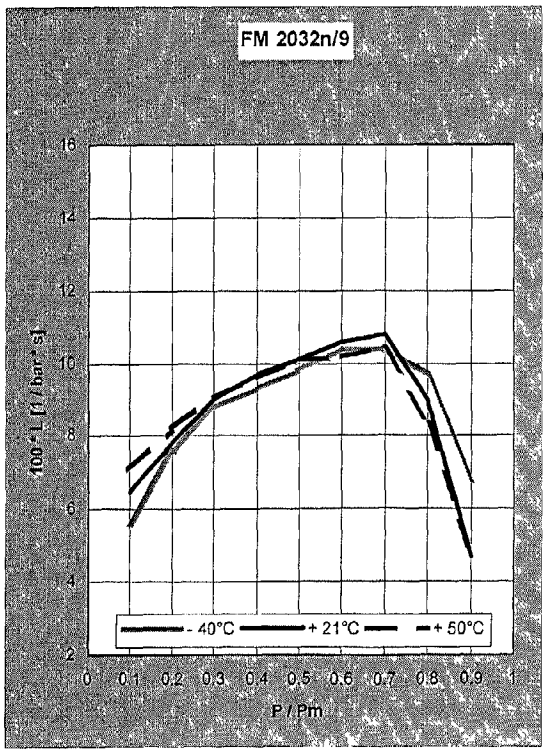
Figure 1C:
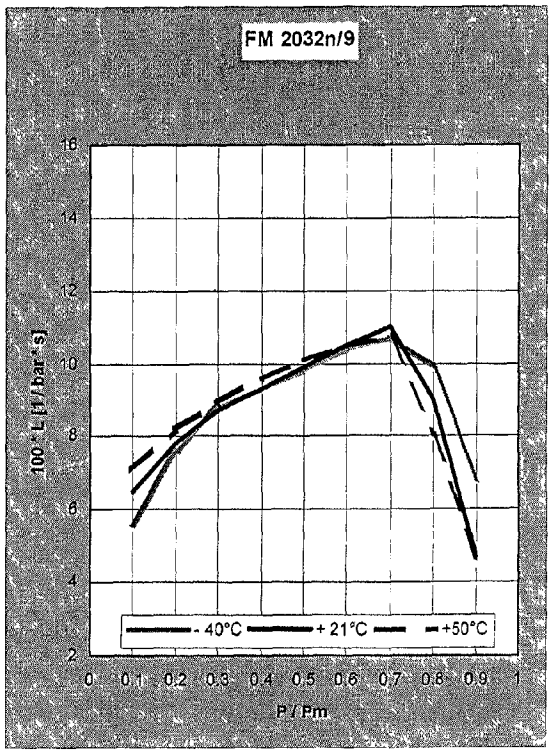
Figure 2C:
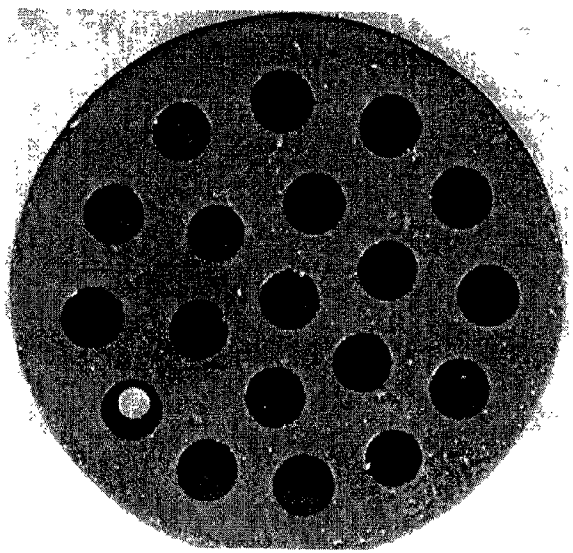
Figure 2B:
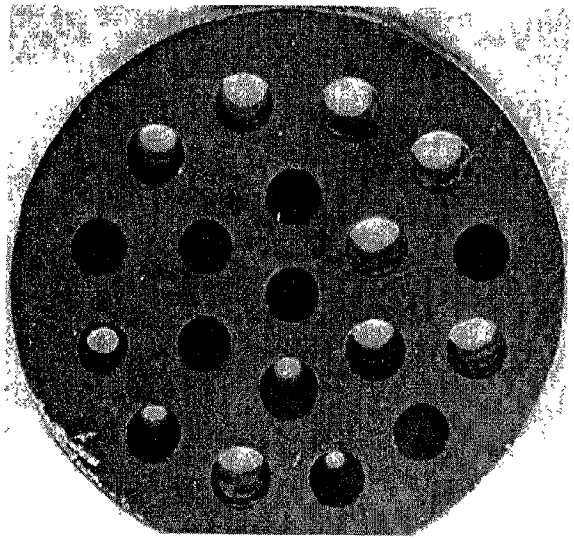
Figure 2A:
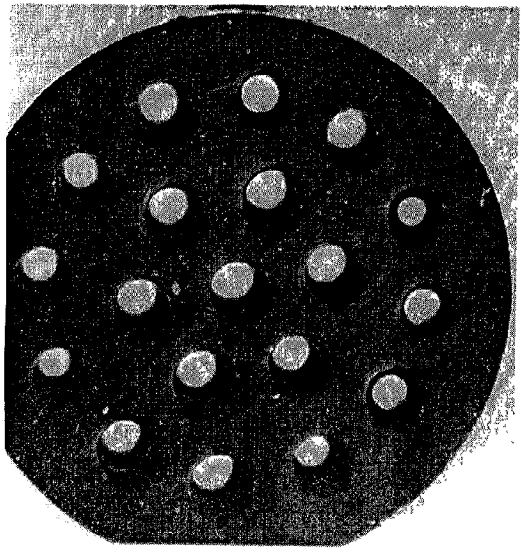
Figure 3A:
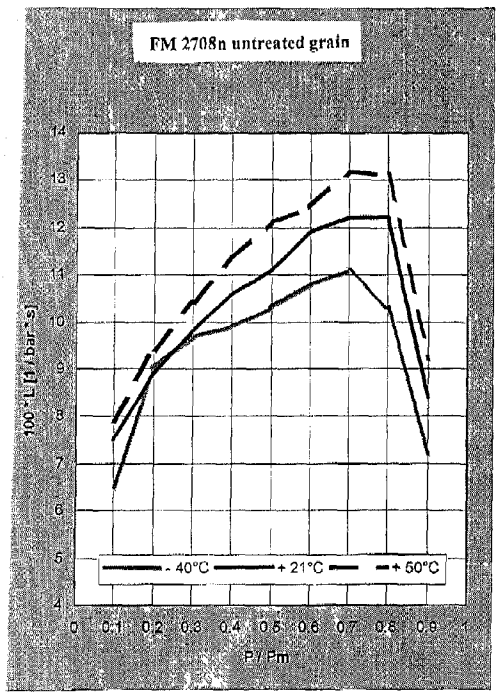
Figure 3B:
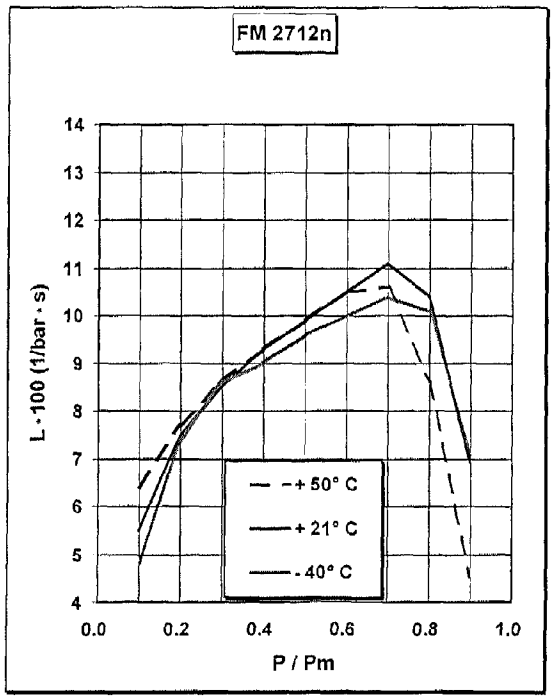
Figure 3C:
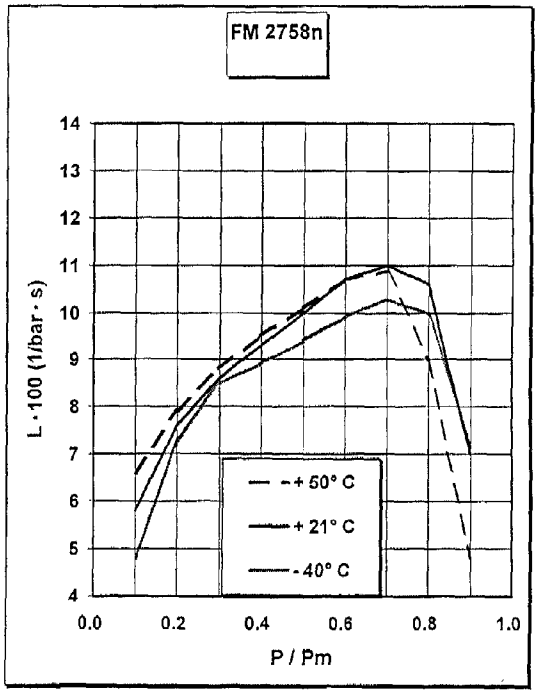
Figure 4A:
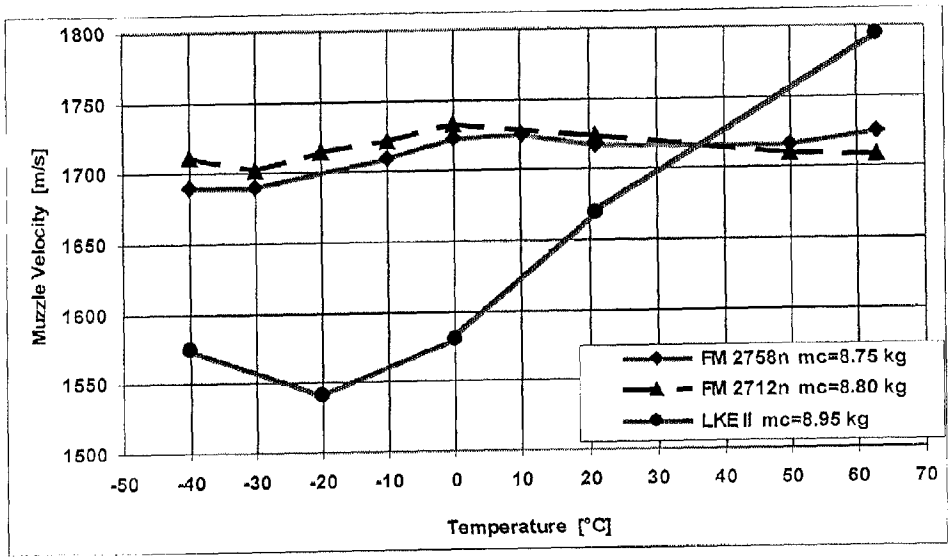
Figure 4B:
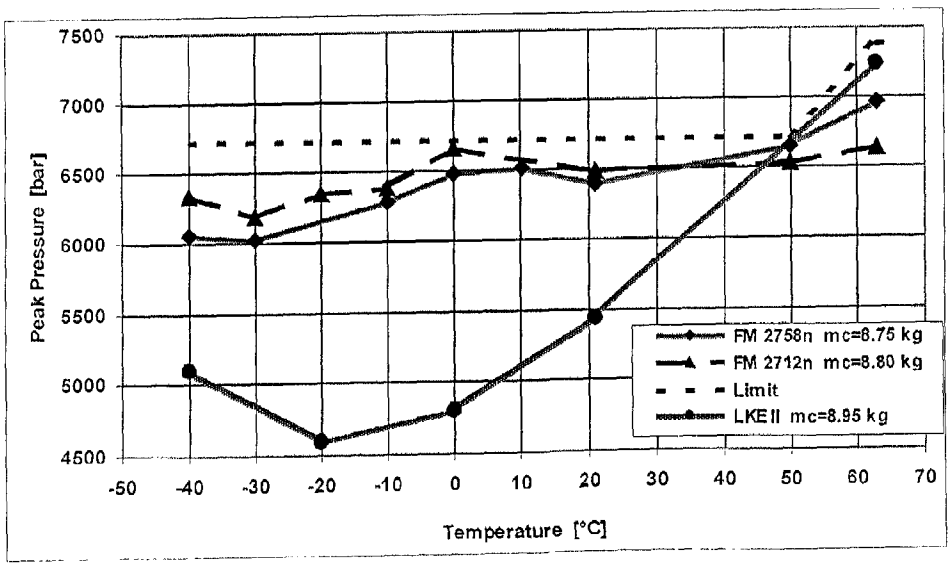
Figure 5A:
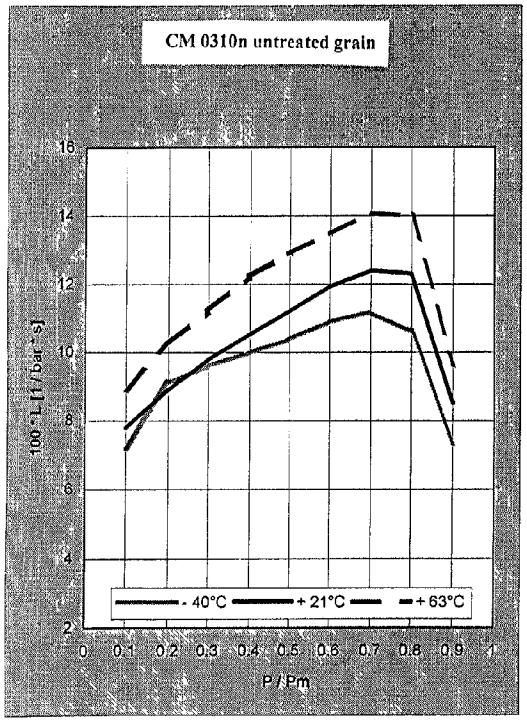
Figure 5B:
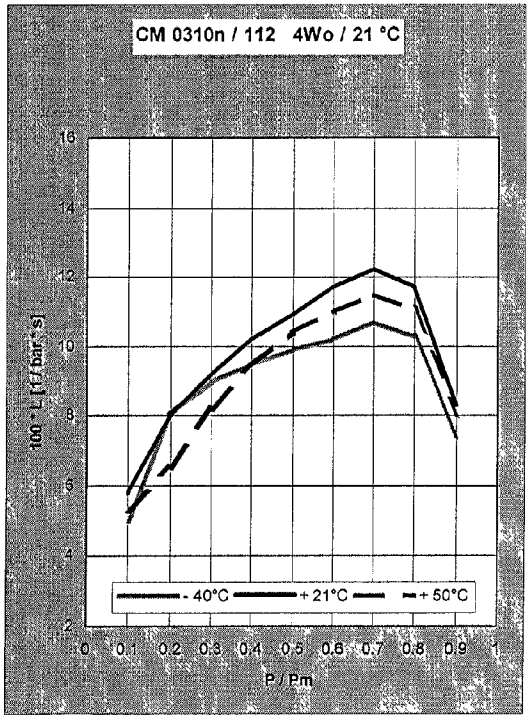
Figure 5C:
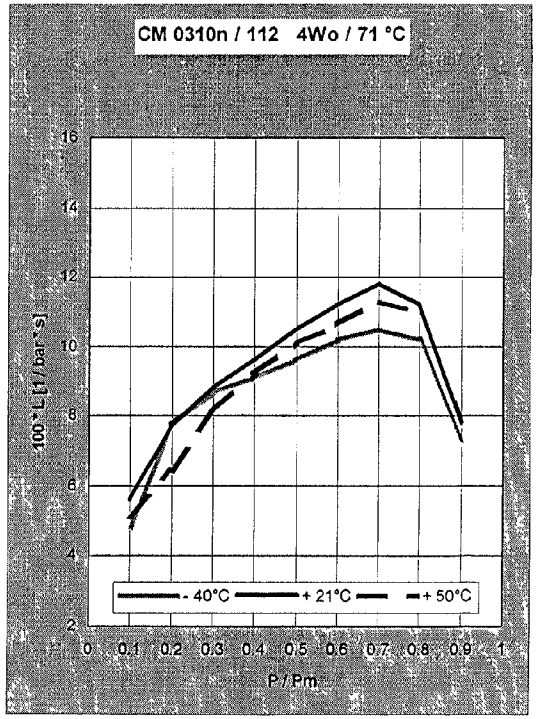
Figure 6:
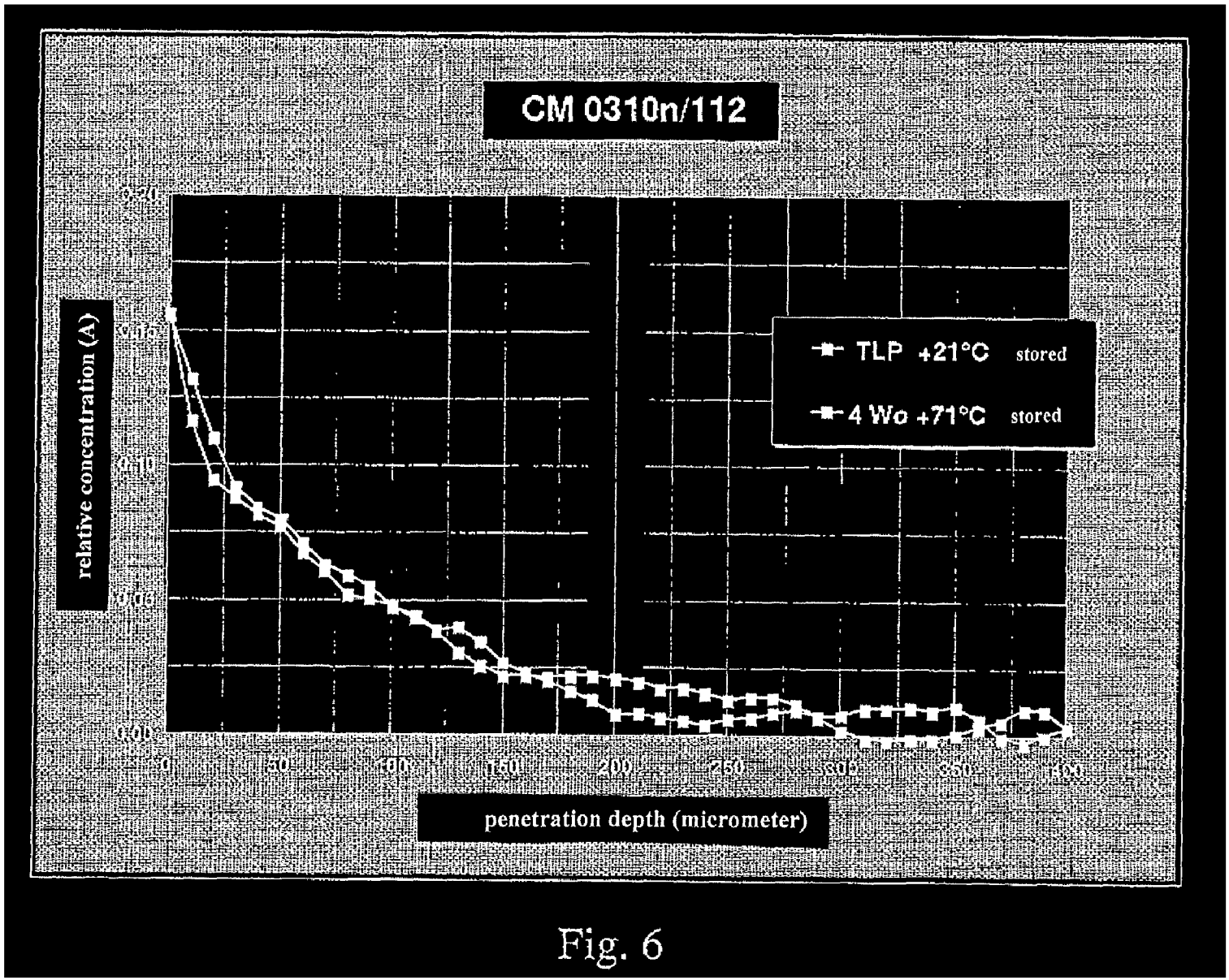
Figure 7:
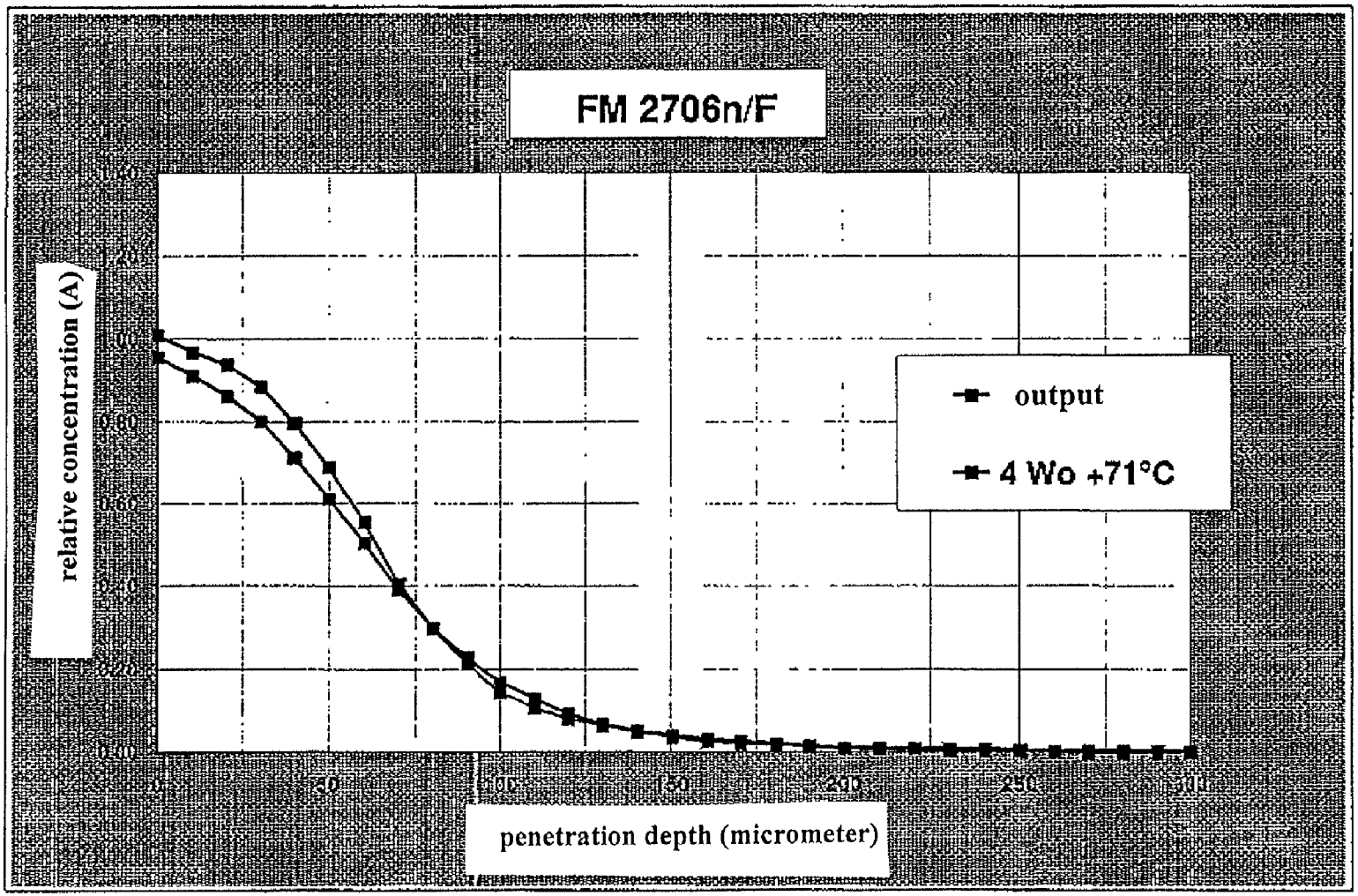
Figure 8A:
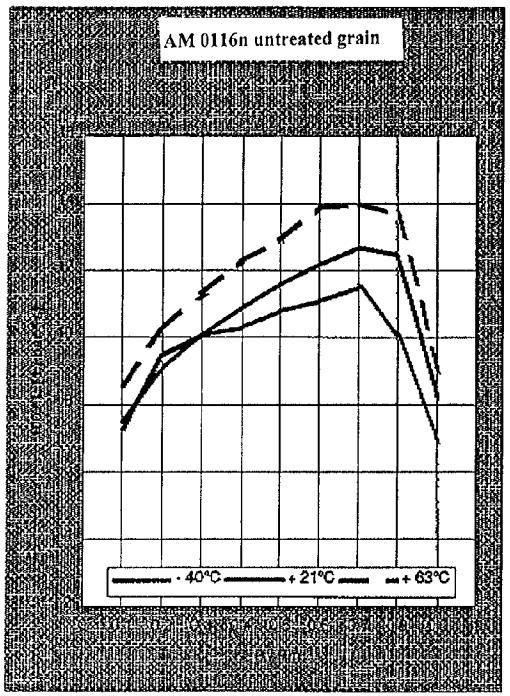
Figure 8B:
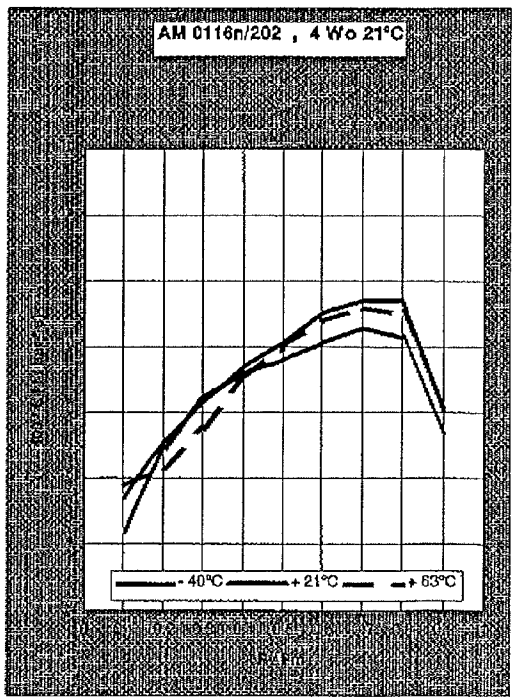
Figure 8C:
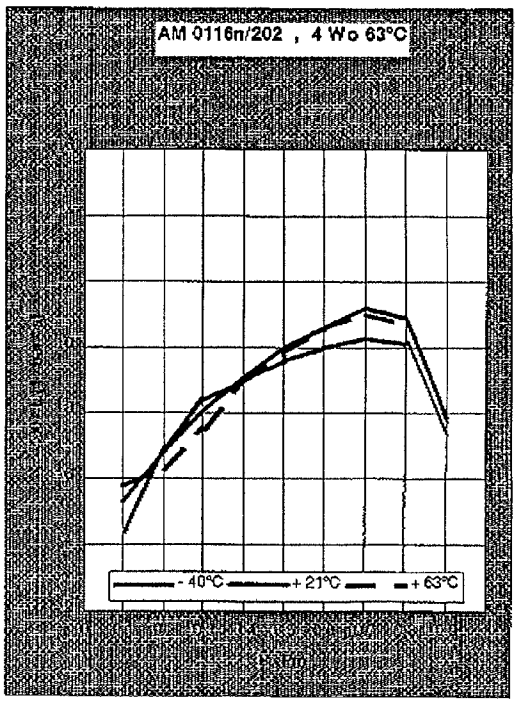
Figure 10A:
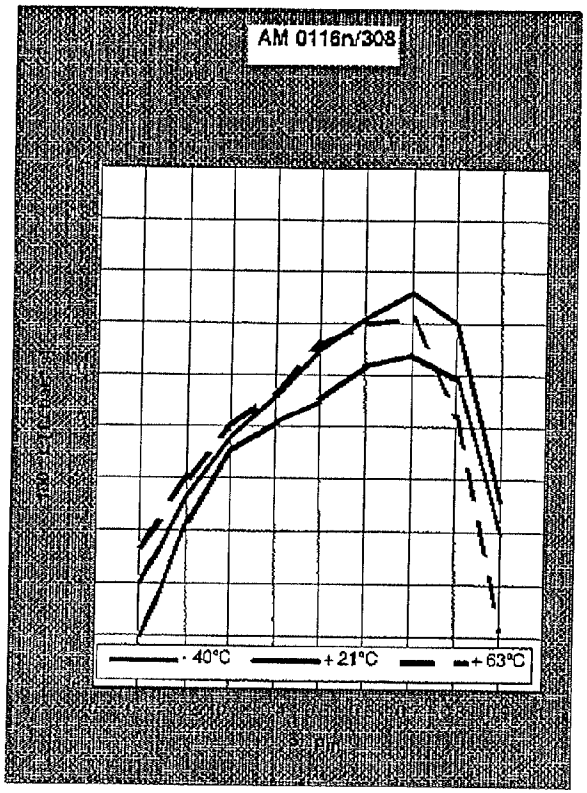
Figure 10B:
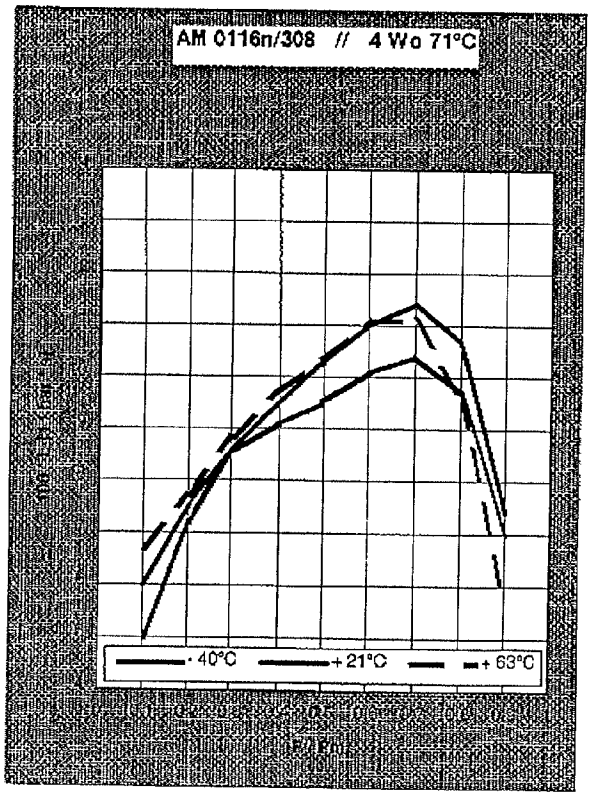

The following drawings are used to explain the embodiments:

FIGS. 1*a–c* Contrasting of the test results for FM 2032n/9;

FIGS. 2*a–c* Representation of the ignited propellant grains;

FIGS. 3*a–c* Pressure bomb tests with untreated grain FM2708n and with samples for FM2712n and FM2758n;

FIGS. 4*a–b* Representation of the pressure curve and the peak gas pressure in dependence on the temperature during the weapon firing;

FIGS. 5*a–c* Representation of dynamic vivacity of the untreated, the treated and the aged propellant in the pressure bomb;

FIG. 6 Concentration profiles of the cross-linked moderator (propoxylated glycerin triacrylate) before and after the accelerated aging (4 weeks, 71° C.);

FIG. 7 Concentration profiles of the cross-linked moderator ethylenediglycol dimethacrylate before and after the accelerated aging (4 weeks at 71° C.);

FIGS. 8*a–c* Reduction in the dependence of the burning on the temperature and ballistic stability for the untreated propellant that is stored at 21° C. for 4 weeks, and the treated propellant that is stored at 63° C. for 4 weeks;

FIGS. 9*a–d* Pressure bomb firings at different propellant powder temperatures of the untreated grain (FIG. 9*a*), the treated propellant (FIG. 9*b*), the treated propellant that is aged faster (FIG. 9*c*) and a mixture of 70 weight % of untreated grain and 30 weight % of treated grain (FIG. 9*d*);

FIGS. 10*a–b* Pressure bomb firings with propellant that is on the one hand stored gastight and, on the other hand, artificially aged.

Figure 11B:
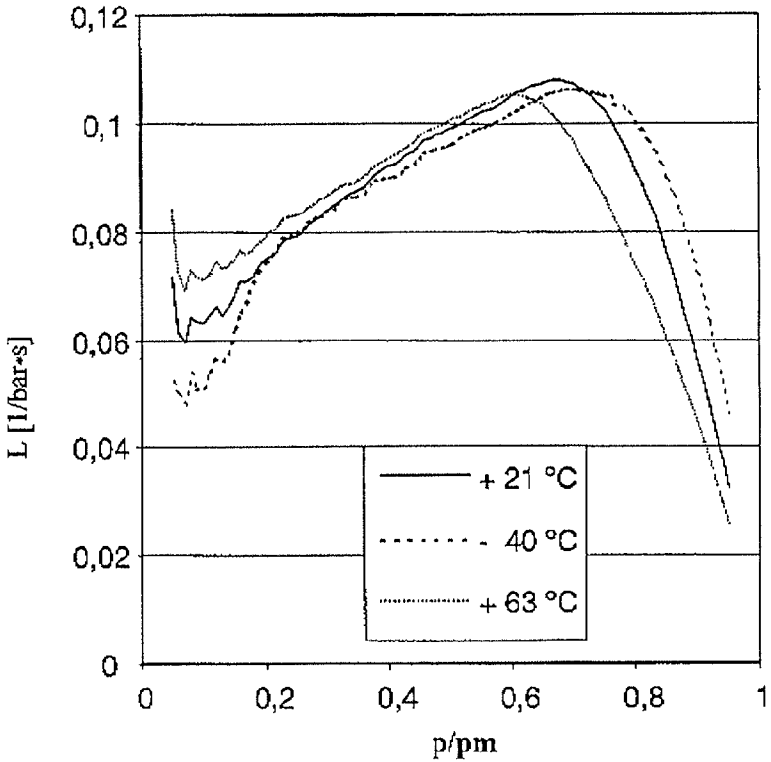
Figure 11A:
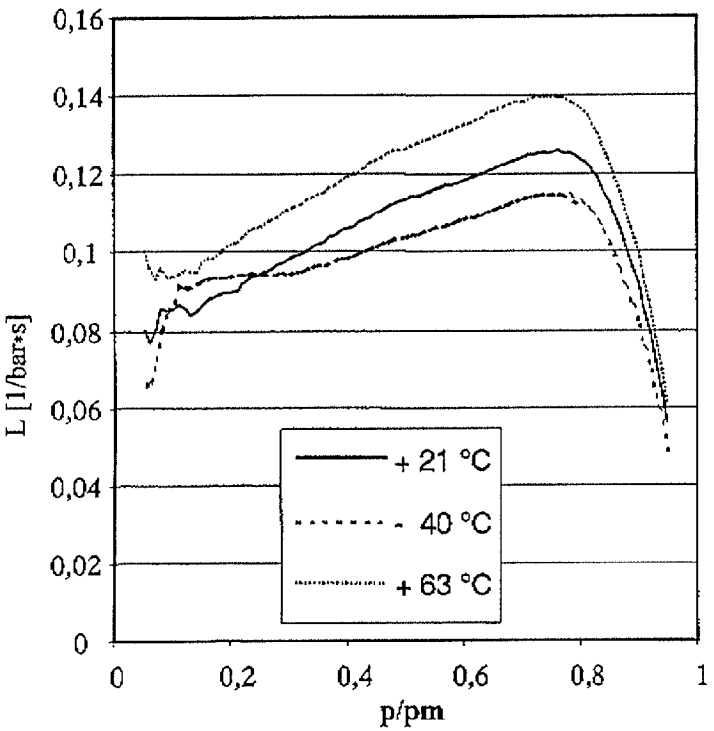

FIGS. 11*a–b* Dynamic vivacity values for the untreated grain and the treated grain without the addition of plasticizer at different temperatures inside the pressure bomb.

MEANS FOR REALIZING THE INVENTION

A special surface treatment is realized to obtain the temperature-independent propellants according to the invention:

For this, a solid material, a plug-stabilizing moderator and a low-viscous liquid are added to the untreated perforated grains inside a polishing drum and the components are then rotated during a predetermined time interval, at a specific temperature and with a specific rotational speed. The individual surface-treatment materials must be compatible with the untreated grain.

The compatibility must be determined from case to case with suitable measuring methods. For example, intensive mixtures of untreated grain and surface treatment materials must be analyzed in the heat flow calorimeter (HFC) at 80° C. to determine extensive heat development, or excessive amounts of the surface treatment material are deposited on the untreated grain or diffused into the untreated grain. These samples are then subjected to the 90° C. weight-loss test or are examined in the heat flow calorimeter (HFC). Another test for determining the compatibility is the determination of the deflagration temperature of such surface treatment materials/untreated grain mixtures.

Concerning the Solid Material:

The solid material used can be a pure material or a mixture of different solid materials. It is important in this connection that the average grain size of the solid material or the solid-material mixture is in a favorable range if the solid material or the solid material mixture are not soluble in the low-viscous liquid. It should be possible to insert the solid material or the solid-material mixture without problems and with the aid of the mixing apparatus into the hole. The material should furthermore compact easily, so that the plug is sufficiently firm. The solid material grain size, for example, should not exceed more than 1/10 of the hole diameter.

These grain sizes are between 0.01 and 200 microns, preferably in the range of 0.1 to 50 microns. (The grain sizes for the exemplary embodiments, described in the following, ranged from 0.5 to 45 micrometers). The liquid and solid material as well as the ratio of solid material to liquid should be selected such that the solid material grains do not agglomerate, but retain their full mobility. This is important for an efficient capping of the outer ends of the perforations.

The average grain size logically does not play a role if the solid material or the mixture of solid materials is soluble in the low-viscous liquid.

Preferred are solid materials or solid material mixtures, which are not soluble in the liquid used.

In principle, any type of solid material or solid material mixture can be used, which is chemically stable in the deployment temperature range for the propellant powder, is compatible with the propellant formulation and therefore does not negatively influence the chemical service life. In addition, the solid material should not melt over the complete production, firing and storage temperature range and should not sublimate away and/or diffuse into the propellant grain to a considerable degree during the complete service life. The substances are advantageously selected to have a melting point that is at least 10° C.–20° C. above the maximum deployment temperature. Preferred are substances with a melting point above 90° C., which are insoluble in the propellant formulation or, at best, have only a slight solubility.

In addition, solid materials or solid material mixtures that positively influence the propellant are preferred (low vulnerability ammunition (LOVA) characteristics, high bulk density, good pourability, erosion reducing, gun flash damping, high energy content, electrical conductivity and good ignition ability).

The solid materials or the mixtures of solid materials concerned are primarily inert substances.

Owing to the fact that the propellant powder is ignitable, the amounts used of the inert solid material or the mixtures thereof should be as low as possible. Relative to the untreated grain, between 0.001 and 4 percent inert solid materials or solid material mixtures are used, preferably between 0.01 and 2 percent.

Examples of inert solid materials, which can be used in the pure form or as mixtures, are graphite, talcum, titanium oxide, potassium cryolite, wolfram trioxide, molybdenum trioxide, magnesium oxide, boron nitride, potassium sulfate, Acardit, Centralit, calcium carbonate, oxalamide, ammonium carbamate, ammonium oxalate, etc. Polymers and copolymers with or without functional groups, linear, branched or crosslinked are also considered.

Concerning the Plug Stabilizing Moderator:

Solid or liquid substances are used as moderators, wherein the solid moderators should dissolve in the low-viscous liquid, which is used as third component. Liquid moderators or moderator solutions can also be present in the low-viscous liquid as emulsifying agent.

Suitable as moderators are in principle all solid and liquid substances, which have a good chemical compatibility with the basic formulation of the untreated grain and have a low volatility (e.g. vapor pressure at 21° C. of $<10^2$ bar). The moderator can be used as pure substance or as a mixture of substances.

Inert substances are generally used as moderators, but energetic "moderators" can also be used. However, these must be insensitive to the mechanical stress exerted during the surface treatment process, during the later ammunition processing or during the ammunition transport and deployment.

The amounts of moderators or moderator mixtures used are between 0.001 and 4%, preferably between 0.01 and 2%.

The moderator can either be soluble or insoluble in the propellant powder matrix. If the moderator is soluble, it is also referred to as deterrent or deterrent and can be used in accordance with this function, which is known per se.

When using a moderator that is soluble in the propellant powder matrix, a concentration gradient forms in the outer propellant layer during the surface treatment. This concentration gradient can break down as a result of diffusion during the service life of the propellant, which consequently changes the burning characteristics of the propellant. For the most part, this manifests itself in higher vivacity and peak gas pressures, which unfavorably influences the ballistic characteristics. In the extreme case, it can destroy the weapon.

This ballistic instability of the propellant (caused by diffusion processes) must be prevented. The problem of moderator diffusion therefore is of central importance to the surface treatment of propellants. The diffusion phenomena depend on the propellant powder composition, the type of moderator used and the temperature.

The diffusion of moderators is favored relatively strongly if double base or multi-base propellants with high blasting oil concentrations are used. The surface treatment according to the invention therefore must be designed in such a way that no change or only a slight change caused by diffusion of the internal ballistic characteristics occurs during the propellant storage. If easily diffused moderators are used, either sufficiently small amounts must be used, or it must be ensured that the diffusion process is practically finished before the propellant powder is packed into the ammunition.

Alternatively, moderators can be used for the surface treatment according to the invention, which cannot noticeably diffuse into the propellant matrix. This can be achieved in two ways:

1.) Moderators are used, which are easily dissolved in the untreated grain matrix and which carry two or more radically polymerizable groups. Once the moderators are diffused in, they are polymerized. The resulting network is highly molecular, insoluble and entangled with the propellant powder matrix and is thus diffusion stable.

2.) A moderator is used, which is not soluble in the untreated grain and additionally has an extremely low vapor pressure at room temperature. Following the surface treatment, this moderator only sits on the untreated grain surface and for affinity reasons can practically not diffuse into the propellant grain. A moderator loss on the propellant surface as a result of evaporation/sublimation is negligible with a sufficiently high molecular weight.

Low-molecular, soluble moderators, which are suitable for the surface treatments of double base or multi-base propellant powders according to the invention, have the lowest possible vapor pressure at 21° C. and are either liquid materials or solid materials, if they are soluble in the low-viscous liquid. Suitable materials include ether, ester, urethane, urea and ketone. Examples are camphor, dibutyl phthalate, diamyl phthalate, centralit, dipropyl adipate, di(2-ethylhexyl)adipate, diphenyl urethane, methyl phenyl urethane, hexanediol-diacrylate, ethyleneglycol-dimethacrylate, and the like.

Also suitable are oligomeric, soluble moderators such as polyether and polyester with molecular weights of 500 to 3000 Dalton. Examples for these are poly(tetrahydrofuran), polymethylvinylether, poly(oxyethylene), polyethyleneglycol, poly(butanediol)divinylether, polyester materials such as SANTICIZER 431, PARAPLEX G-54, or poly[di(ethyleneglycol)adipate, polyethyleneglycol, polyethylene glycolacrylate, polyethyleneglycolmethacrylate, polyethyleneglycoldiacrylate, poly ethyleneglycoldimethacrylate, polyethyleneglycoldimethylether, poly(propyleneglycol), poly(propyleneglycol)acrylate, poly(propyleneglycol)diacrylate, poly(propylene glycol)ether, polycaprolactonediol, polycaprolactonetriol and all co-oligomers derived thereof. Polymerization reactions are not realized for the acrylates/methacrylates.

The radically cross-linkable moderators comprise low-molecular compounds and oligomers or polymers, which have at least two groups that can be radically polymerized for each molecule.

The radically cross-linked moderators furthermore comprise mixtures of:

Low-molecular mixtures, respectively oligomeres or polymers having at least one group that can be polymerized for each molecule; and Mixtures carrying at least two groups that can be polymerized.

These compounds are either insoluble in the propellant powder matrix and therefore remain at the propellant surface, or they are soluble and thus diffuse into the top propellant layer during the course of the surface treatment according to the invention. A suitable thermally activated radical starter (initiator) must then be added to the cross-linkable moderator. The initiator should easily dissolve in the moderator, such that it is homogeneously distributed in the moderator. The treatment conditions and the initiator should be selected such that the initiator, if possible, cannot decompose into radicals during the surface treatment process in the polishing drum. If initiator and polymerized moderator are present either as a layer on the propellant surface or diffused into the outer propellant layer, the atmospheric oxygen and, in part, the oxygen present in the outer propellant layer are removed in the vacuum, at room temperature, and are replaced with inert gas. This is necessary so that the radical reactions (polymerization, cross-linking) can occur without interfering side reactions and result in a high yield. The propellant temperature is raised high enough under the effect of inert gas, so that the initiator decomposes as fast as possible and completely into radicals. These radicals subsequently start the polymerization or the cross-linking of the moderators.

Initiators are preferably used as radical starters, which practically do not decompose into radicals at room temperature, but decompose very quickly into the respective radicals at temperatures around 60° C. to 90° C. A quick, careful and complete conversion of the polymerizable moderators is thus ensured. Examples for suitable radical starters include tert. butylperoxyneodecanoat, di(4-tert.butyl cyclohexyl)peroxydicarbonate, tert. butylperoxypivalate, diauroylperoxide, bis(azaisobutyronitrile), etc.

The amount used of the polymerization initiator is based on the amount of the cross-linkable moderator that is used. Thus, between 0.1 and 5 mol % initiator, relative to 1 mol moderator are used. Preferred are initiator amounts between 1 and 4 mol %.

Moderators that can be cross-linked and are soluble in the propellant powder are derivatives of diacrylates, triacrylates, tetraacrylates, dimethacrylates, trimethacrylates, tetramethacrylates, diacrylamides, triacrylamides, dimethacrylamides, trimeth-acrylamides, divinylesters, trivinylesters, divinylethers, trivinylethers, divinyl aromatic compounds, trivinyl aromatic compounds and the like.

Examples for low-molecular, radically cross-linkable moderators are hexanediolacrylate, hexanediolmethacrylate, ethyleneglycol-dimethacrylate, tetraethylene glycol-diacrylate, triethyleneglycol-diacrylate, dipropyleneglycol-diacrylate, trimethylol propane-triacrylate, pentaerythritoltetraacrylate, and the like.

Examples for oligomeric, radically cross-linkable moderators are low-molecular polyethyleneglycoldiacrylate, low-molecular polyethyleneglycoldimethacrylate, ethoxilated bisphenol A-diacrylate, propoxylated neopentylglycoldiacrylate, ethoxilated neopentyl-glycol-diacrylate, propoxylated glycerin-triacrylate, ethoxilated pentaerythritoltetraacrylate, and the like.

Examples for polymeric, radically cross-linkable moderators are polybutadienediolacrylate, high-molecular polyethyleneglycoldiacrylate, high-molecular polyethyleneglycoldimethacrylate, high-molecular polypropyleneoxidediacrylate, and the like.

Moderators that dissolve only slightly or not at all in the propellant powder are solid or liquid compounds, which are soluble in the low-viscous liquid or at least can be finely emulsified therein. The compounds in question can be inert or energetic substances. A precondition is that the moderator concentration on the propellant surface cannot change through sublimation or diffusion. This can be achieved by using high-melting low-molecular or oligomeric or polymeric compounds. In addition, the volatility of insoluble compounds, containing polymeric groups, following deposition on the propellant grain can additionally be reduced through a polymerization reaction (as described in the above).

Suitable insoluble moderators are apolar polymers and oligomers or strongly polar polymers and oligomers with or without polymerizable groups.

Examples for these include totally or partially hydrolized polyvinyl acetate, poly(vinylalcohol-co-ethylene), polybutadiene, polybutadienediol, polybutadiene dioldiacrylate, polystyrene, polyvinylpyrrolidon, poly(acrylonitrile-co-butadiene), poly(α-methylstyrene), poly(vinyltoluene-co-α-methylstyrene), and the like.

Concerning the Low-Viscous Liquid:

The low-viscous liquid necessary to realize the surface treatments according to the invention is a solvent or solvent mixture that can easily dissolve or finely emulsify the solid or liquid, plug-stabilizing moderator and swells the propellant grain only slightly or not at all. Particularly suitable are liquids with high or low polarity. The boiling point for the liquid must be higher than the surface treatment temperature. The low-viscous liquid nevertheless should have sufficiently high volatility to permit evaporation at the treatment temperature during a short period of time (between 5 and 60 minutes). If necessary, the liquid can also be removed with the aid of a pressure reduction or by means of a warm gas flow. The liquid can be a pure solvent or a solvent mixture, wherein amounts of 0.1% to 5% liquid (relative to the propellant amount), preferably between 0.5% and 2%, are used for the surface treatment.

Examples for particularly suitable low-viscous liquids are water, mixtures of water and methanol, mixtures of water and ethanol, mixtures of water and propanol, mixtures of water and acetone, mixtures of water and tetrahydrofuran, as well as pentane, hexane, heptane, cyclohexane, toluene, methylene chloride and mixtures thereof.

Perforated propellants are processed with the above-mentioned substances inside a polishing drum. For this, the volume of an optionally large polishing drum of steel or copper is partially filled with a perforated propellant, wherein the minimum volume is limited to approximately 10 liters. The desired degree of filling is between 5 and 50%, preferably between 10 and 40%. The propellant can be non-graphitized or graphitized. For this, the solid material or solid material mixture is initially deposited in the rotating drum and is thus distributed homogeneously over the complete propellant surface. If the propellant powder used has already been graphitized sufficiently, it is possible to omit the further introduction of solid material or a different type of solid material can be added, if necessary. Following this, a solution consisting of the low-viscous liquid and the moderator or the moderator mixture is added. In case of a desired cross-linking of polymerizable moderators, this solution additionally contains the polymerization initiator.

At least one of the solid material components should either be graphite dust or acetylene carbon black, owing to the fact that for safety reasons (electrostatic charging during the transport of propellants), the propellant powder must always be covered with an electrically conducting material layer.

If the solid material consists of an inert (non-energetic) material, it is used only in small amounts (relative to the propellant). Thus, between 0.01% and 2% solid material is homogeneously distributed over the propellant powder inside the polishing drum. If an energetic material is added, a concentration of more than 2% can be used since this mixture will ignite better.

Given an optimum propellant grain flow, the added substances are allowed to act upon the propellant surface during a specific time interval and at temperatures of between 0° C. and 90° C., preferably between 20° C. and 70° C. The reaction process lasts between 5 minutes and 4 hours, preferably between 15 minutes and 120 minutes. The polishing drum must be closed gas-tight during the reaction time (depending on the vapor pressure of the liquid that is used).

Following the reaction time in a gas-tight treatment apparatus, the lid on the filling hole is normally removed so that most of the low-viscous liquid can evaporate. Even this evaporation process must be exactly controlled with respect to time. The time interval can be between 5 minutes and 4 hours and is preferably between 10 minutes and 120 minutes. Additional measures can be used to aid or support the evaporation, e.g. an air flow or inert gas flow can be guided over the moist propellant.

If non-polymerizing moderators are used, the treated propellant powder is subsequently subjected to a severe drying process during in which the last traces of solvent are removed and the treated layer is stabilized. Thus, the propellant powder typically remains for approximately 3 days inside a forced-air oven at a temperature of 60° C. Ethanol, for example, can be removed completely (<0.01%) in this way.

A corresponding polymerization initiator is furthermore added if a radically polymerizable moderator is used and a polymerization reaction must be realized. The surface treatment of the propellant is realized at the lowest possible temperature and the low-viscous liquid is removed at the same temperature. The surface treatment is preferably realized at room temperature. Subsequently, the propellant powder is freed in the vacuum of solvent residues and atmospheric oxygen and is subjected to inert gas. Alternatively, the propellant powder can also be flushed only with the inert gas to displace the atmospheric oxygen. Argon or nitrogen, for example, can be used as inert gases. The propellant powder mass subjected to inert gas is heated only then to the required polymerization temperature, which normally ranges from around 30° C. to 60° C. above the treatment temperature.

If the treatment is realized at room temperature, for example, then a polymerization initiator that is thermally stable at room temperature is used, but which decomposes quickly into the respective radicals at 50° C. to 80° C.

The decomposition half-life of a polymerization initiator is the time, during which half of the initiator had decomposed into radicals at a specific temperature. This decomposition half-life is known for all commercially available thermal initiators because of its central importance. To ensure that the polymerization reactions are as complete as possible, the duration of the polymerization at a specific temperature is fixed at four to six times the decomposition half-life for the initiator used at this temperature. The propellant powder is then allowed to cool down to room temperature, either by remaining in the environmental air or being subjected to inert gas. Owing to the fact that low-boiling, apolar solvents are preferably used for depositing the polymerizable moderator, the propellant powder is practically solvent-free following the evacuation and polymerization steps.

As a result of the above-presented surface treatment processes, the entrances to the perforation tunnels are closed off with compact, condensed plugs, which consist primarily of the solid materials or material mixtures used and the moderator.

The low-viscous liquid and/or the moderator (deterrent) soluble in the propellant powder in this case causes the plug to be additionally compacted and anchored inside the perforation tunnel.

Surprisingly, it was discovered that with a correct selection of the treatment parameters, all surface-treated, perforated propellant powders exhibit considerably reduced temperature dependence or even a mostly temperature-independent characteristic during the burning. It was observed that with an ignition at high propellant temperatures, the plugs are anchored practically permanently inside the perforation tunnels and remain in place. As a result, the ignition of the propellant during the first burning phase differs from the classic behavior because of the changed form function and the inherently fast propellant powder burning at high temperatures is strongly compensated. If the same propellant powder is ignited at room temperature, the form function changes in the sense that a faster surface area enlargement occurs and thus the gas-formation rate can be adapted to the gas-formation rate at high deployment temperatures. Finally, it was observed that for very low propellant temperatures, the gas-formation rate for perforated propellants adapts to that of an untreated grain as a result of reaching a classic behavior with respect to form function.

The burning inside the propellant perforations is thus slowed down with increasing propellant temperatures as a result of the treatment influence on the form function. This counteracts the rate at which the propellant powder burns, which increases with the increase in the temperature. In the ideal case, the two effects balance each other, so that the burning of the surface-treated propellant is independent of the temperature.

The active mechanism according to the invention thus differs completely from other mechanisms described in the literature for achieving a reduced temperature dependence. In particular, this mechanism is not based on the (dangerous) embrittlement of the propellant at low temperatures.

With the correct selection of the surface treatment components, this effect is retained even if the treated propellant is subjected to an accelerated aging process (e.g. stored for 4 weeks at 63° C.) or is stored for a very long time at room temperature. Thus, the surface-treated propellant has a good ballistic stability, meaning the ammunition filled with this propellant can be fired safely and delivers a uniform performance.

In addition, it was determined that the surface treatment according to the invention has a favorable effect on the pourability and the bulk density of the propellant powder. The bulk densities of treated propellant powders are therefore up to 10% higher than the bulk densities of untreated propellant powders.

Since the casing volume of an existing ammunition component is predetermined, more propellant powder can be inserted into this predetermined casing volume with increased bulk density.

TI (temperature-independent burning characteristic) behavior and high bulk density make it possible to fill more propellant powder into existing casings. Thus, the kinetic energy of the projectile can be raised without exceeding the specified maximum pressure in the weapon over the complete temperature range for deployment.

A propellant that was subjected to a surface treatment according to the invention is therefore suitable for realizing a noticeable and cost-effective increase in the fighting efficiency of presently existing weapon systems, without affecting the complete system compatibility. This treated propellant furthermore can also be used in newly developed weapon systems. The ignition, for example, can be improved and/or the barrel erosion reduced through an intelligent selection of solid materials.

The core of the invention can be summarized as follows:

1.) A non-volatile solid material is worked into the perforations of a double base or multi-base propellant grain inside suitable treatment apparatuses. Used for this are solid materials with an average grain size that is clearly smaller than the perforation diameter, suitable moderators for the plug stabilization and an adequate amount of easily removed low-viscous liquid.

2.) The treatment layers formed with the solid material are compacted and anchored inside the perforations with the aid of the moderator and the low-viscous liquid, such that with increasing deployment temperature the closure becomes more resistant against the ignition shock, thus influencing the form function. The plug characteristic remains unchanged over the complete product service life of the propellant (ballistic stability).

3.) Type and concentration of the solid material, the moderator and the low-viscous liquid together with the surface treatment parameters (mass, temperature, speed, treatment length, etc) are adapted to each powder grain and the respective ignition to obtain an optimum result.

4.) As a result of a stronger surface treatment (increase in the concentration of solid material and/or moderator and/or the treatment duration), the normal temperature dependence of the propellant combustion can even be inverted. Propellants that are highly treated in this way burn faster at low temperatures than at high temperatures ("negative temperature coefficient").

5.) Propellant powders that burn temperature independent can also be produced by mixing highly treated propellant powder (with inverted burning) with untreated propellant powder. Generally, the brisance or shattering power can be varied over a wide range by mixing treated and untreated propellant powders.

New types of propellant bulk powders with strongly reduced to neutral temperature sensitivity (homogeneously treated propellant powders) can also be produced by controlling the parameters described in Points 1) to 3).

The following can be said with respect to the examples described below:

The propellant powder raw mass consisted of 58% nitrocellulose, 26% nitroglycerin and 16% diethyleneglycoldinitrate, wherein Acardit II was used as stabilizer.

The perforated untreated grain was produced in an extruder with a 19-hole matrix. The matrix dimension is given for each example.

The treated grain with practically temperature-independent burning, which was subjected to a surface treatment, is also referred to as SCDB (surface coated double base) propellant grain.

EXAMPLE 1

(FM 2032n/9)

An amount of 90 kilograms of untreated grain, produced with a matrix of 10.5×(19×0.2) mm, is placed inside the treatment apparatus (treatment drum) at a temperature of 16° C. Added to this are 180 grams graphite (0.2 weight % relative to the propellant powder) and a solution of 1440 milliliters of 80% by volume ethanol (16 ml per kilogram propellant powder) and 225 grams of polytetrahydrofuran 650 (0.25 weight % relative to the propellant powder).

In the gastight, sealed drum, the mixture is mixed at 16° C. while rotating at 14 rpm for 30 minutes. Following this, the lid is removed from the polishing drum and the solvent is allowed to evaporate during a period of 105 minutes.

The treated propellant powder is dried at 60° C. over a period of 3 days.

FIGS. 1*a–c* contrast the test results for burning a propellant powder in the ballistic bomb. The ratio of the momentary pressure P to the maximum pressure Pmax is plotted on the abscissa while the dynamic vivacity (1/bar sec)×100 is plotted on the ordinate. FIG. 1*a* shows the behavior of the untreated grain at deployment temperatures of −40° C., +21° C. and +50° C. FIG. 1*b* shows the pressure bomb tests conducted immediately after the propellant powder production and FIG. 1*c* shows these tests conducted after a 5-year storage time at 21° C.

As compared to the untreated grain, the treated grain subjected to a surface treatment (SCDB) FM 2032n/9 shows very little vivacity differences in the 150 ml pressure bomb (charge density 0.2; firing at −40° C., +21° C. and +50° C.) for the three propellant powder temperatures. Thus, the burning for all practical purposes does not depend on the temperature.

A portion of the treated propellant powder is stored for 5 years in a closed container at room temperature. A pressure bomb is again test-fired with this stored propellant powder (FIG. 1*c*). The propellant powder shows the same dynamic vivacity values as 5 years earlier, meaning the burning continues to be temperature-independent.

EXAMPLE 2

(FM 2712n)

Placed into a large treatment apparatus are 220 kilograms of untreated grain, produced with the aid of a 12.0×(19×0.20) mm matrix, and preheated to 30° C. Added to this are 187 grams (0.085 weight % relative to the propellant powder) of graphite and subsequently a solution of 264 grams polytetrahydrofuran 650 (0.12 weight % relative to propellant powder) and 2040 grams 75% by volume ethanol (10.6 milliliter per kilogram propellant powder). The mixture is mixed in the closed drum for 60 minutes at 30° C. and with a rotational speed of 8.25 rpm. Following this, the lid of the polishing drum is removed, another 187 grams (0.085 weight %) of graphite are added and the solvent is allowed to evaporate from the rotating drum during a period of 30 minutes.

The propellant powder treated in this way is dried over a period of 3 days at 60° C.

EXAMPLE 3

(FM 2758n)

This treatment is realized in exactly the same way as for Example 2.

To confirm the mechanism of the temperature-independent burning of the propellant powder, powder grains were tested in a quenching bomb at different temperatures. A rupture disc opened the bomb at approximately 700 bar and the burned propellant grains are thrown into a water bath and quenched. The recuperated, partially burned propellant grains were then photographed.

FIGS. 2*a–c* show the burned propellant grains, which were fired at −40° C., +21° C. and +50° C. It is clearly noticeable that at low temperatures, other form function characteristics contribute to the burning mechanisms than at high temperatures.

FIG. 3*a*, on the other hand, shows the pressure bomb test results for the untreated grain FM2708n. FIGS. 3*b* and 3*c* show the test results for the two samples FM 2712n and FM2758n. It is quite obvious that the temperature dependence of the propellant powder burning could be reduced considerably.

These samples were also subjected to a weapon firing. FIG. 4*b* (peak gas pressure in dependence on the temperature) shows that no great variations in the pressure curve can be detected over the complete temperature range between −40° C. and +63° C. The measured muzzle velocities furthermore vary only slightly (FIG. 4*a*: muzzle velocity in dependence on the temperature). In contrast, the untreated propellant powder LKE II is highly temperature-dependent for the firing.

EXAMPLE 4

(CM 0310n/112)

An amount of 8 kilograms of untreated grain, produced with a matrix of 12.0×(19×0.20) mm, is originally placed into a treatment apparatus. Added to this are 32 grams (0.40 weight % relative to the propellant powder) of graphite (grain size 45 microns). The graphite is distributed over the complete bulk powder surface by rotating the material at 24 rpm for 5 minutes inside the closed drum.

Following this, a solution consisting of 100 grams of cyclohexane (1.25 weight % relative to the propellant powder), 40 grams propoxylated glycerintriacrylate (0.5 weight % relative to propellant powder) and 2 grams di(4-tert.-butyl cyclohexyl)peroxydi-carbonate (5 weight % relative to the triacrylate) are sprayed onto the rotating propellant powder mass.

The mass is then rotated for 60 minutes inside a gas-tight, closed drum at room temperature. Following that, the lid is removed from the treatment apparatus and the solvent allowed to evaporate from the rotating drum during a period of 30 minutes.

The treated propellant powder is transferred to a vacuum cabinet and is evacuated therein at room temperature until a terminal pressure of approximately 1 mbar is reached. The vacuum cabinet is then filled with nitrogen and the heating turned on. Once the propellant powder has reached a temperature of 70° C., the propellant powder is exposed for approximately two more hours to this temperature. The propellant powder is subsequently allowed to cool down to room temperature.

HPLC (high-pressure liquid chromatography) testing of the treated propellant powder showed that the propellant powder no longer contained free triacrylate.

The amount of 1 kilogram of the treated propellant powder is welded into a gas-tight bag and stored for 4 weeks at 71° C., which corresponds to a storage at room temperature of several decades (50 to 100 years). The remaining propellant powder is stored at room temperature.

Respectively one 150 ml pressure bomb (charge density 0.2) of the artificially aged sample, of the sample stored under normal conditions and of the sample with untreated propellant powder is fired at −40° C., +21° C. and +50° C.

The results are shown in FIGS. 5*a–c*. The dynamic vivacity of the treated propellant powder (FIG. 5*b*) at the different firing temperatures no longer differ as strongly as those of the untreated grain (FIG. 5*a*). The treated propellant powder has become less temperature-sensitive. The dynamic vivacity has not changed as a result of the artificial aging (FIG. 5*c*) because a diffusion of the polymerized moderator is no longer possible. On the one hand, this is due to the strong increase in the molecular weight of the moderator through cross-linking and, on the other hand, through the additional entanglement of the polymeric moderator chains with the nitrocellulose chains. That is to say, the treated propellant powder has ballistic stability.

Analyses of the concentration profile by means of FTIR (Fourier transformation infrared spectrometry) confirm that the cross-linked moderator no longer can diffuse, as shown in FIG. 6 (relative concentration as function of penetration depth). There, the concentration gradients for the moderator are unchanged on the surface of the propellant grains before and after the artificial aging.

EXAMPLE 5

(FM 2706n/F)

An untreated grain, produced with the matrix 11.0×(19×0.20) mm, is treated with a cross-linkable moderator, in the same way as for Example 4.

Ethyleneglycoldimethacrylate was used (1.3 weight % relative to the propellant powder).

Following the cross-linking of the moderator, the remaining amount of ethyleneglycoldimethacrylate was determined with the aid of GC/MS (gas chromatography/microspectrometry). It turned out that >95% of the dimethacrylate was converted. The propellant powder was stored at 71° C. for 4 weeks and its concentration profile was subsequently compared with FTIR microspectroscopy to the propellant powder stored under normal conditions. The concentration profiles of the cross-linked moderator, shown in FIG. 7, prove that diffusion cannot be detected even under drastic storage conditions. In turn, it means that this propellant powder has ballistic stability.

EXAMPLE 6

(AM 0116n/202)

An amount of 8 kilograms of untreated grain, produced with a 12×(19×0.20) mm matrix, is placed into a small rotating drum. The untreated grain was previously heated to 60° C.

Added to the heated, untreated grain rotating at 26 rpm are 12 grams of graphite (0.12 weight % relative to propellant powder). Once the graphite is distributed homogeneously over the propellant powder, a solution of 90 grams of water (1.1 weight % relative to propellant powder) and 5.6 grams of polyvinyl alcohol (0.07 weight % relative to propellant powder) are added and mixed for 70 minutes inside a closed drum at 60° C.

Following this, the lid is removed and the water is allowed to evaporate from the rotating drum during a period of 20 minutes.

The treated propellant powder is dried for three days at 60° C.

FIGS. 8*a–c* show the pressure-bomb firings at different propellant powder powder temperatures of the untreated grain (FIG. 8*a*: untreated), the treated propellant powder (FIG. 8*b*: following storage at 21° C. for 4 weeks) and the treated propellant powder that is aged faster (FIG. 8*c*: 4 weeks at 63° C.). The pressure bomb testing clearly shows the reduction in temperature dependence for the propellant powder burning following the surface treatment according to the invention. This reduction does not change if the treated propellant powder is subjected to an artificial aging process. Polyvinyl alcohol cannot diffuse into the propellant powder matrix because it is not soluble. The treated propellant powder is therefore also ballistically stable.

EXAMPLE 7

(AM 0106n/1)

The amount of 55 kilograms untreated grain, produced with a rosette matrix of 13.7×(19×0.26) mm, is placed into a medium-size surface treatment apparatus that is heated to 30° C. The untreated grain was also preheated to 30° C.

Added to the heated, untreated grain rotating at 13.6 rpm are 55 grams of graphite (0.10 weight % relative to propellant powder). As soon as the graphite is distributed homogeneously over the propellant powder, a solution of 512 grams ethanol (75% by volume ethanol, 25% by volume water), 27.5 grams polytetrahydrofuran 650 (0.05 weight % relative to the propellant powder) are added and all ingredients are mixed at 30° C. for 60 minutes inside the closed drum.

Following this, the closing lid is removed and the watery ethanol is allowed to evaporate from the rotating drum over a period of 15 minutes.

The treated propellant powder is then dried during a period of 3 days at 60° C.

FIGS. 9*a–d* show the pressure-bomb firings for different propellant powder temperatures of the untreated grain (FIG. 9*a*: untreated), the treated propellant powder (FIG. 9*b*: following a storage at 21° C. for 4 weeks) and the treated propellant powder aged at an accelerated speed (FIG. 9*c*: for 4 weeks at 63° C.). The pressure bomb testing clearly shows the reduction in the temperature dependence of the propellant powder burning following the surface treatment according to the invention. This reduction does not change if the treated propellant powder is subjected to an artificial aging process, thus making this propellant powder ballistically stable as well FIG. 9*d* furthermore shows a mixture of 70 weight % of untreated grain and 30 weight % of treated grain. The vivacity of the propellant powder burning can additionally be controlled with mixtures of this type.

EXAMPLE 8

(AM 0116n/308)

An amount of 8 kilogram untreated grain, produced with a matrix of 12.0×(19×0.20) mm, is placed into a treatment apparatus at room temperature. Added to this are 16 grams (0.20 weight % relative to propellant powder) of graphite (grain size 45 microns), which is distributed over the complete bulk powder surface by rotating it in the closed drum for 5 minutes at 24 rpm.

A solution, consisting of 60 grams cyclohexane (0.75 weight % relative to propellant powder) and 12 grams polybutadienedioldimethacrylate (0.15 weight % relative to propellant powder) are subsequently sprayed onto the graphitized propellant powder while the propellant powder mass is rotated.

The mass is mixed at room temperature for 100 minutes inside the closed, gas-tight drum. Subsequently, the lid of the treatment apparatus is removed and the solvent allowed to evaporate from the rotating drum during a period of 20 minutes.

The treated propellant powder is then dried for 3 days at 60° C.

A portion of this surface-treated propellant powder is artificially aged inside a gas-tight bag during a period of 4 weeks at 71° C. (FIG. 10*b*), while the remaining portion of the propellant powder is stored gas-tight at room temperature (FIG. 10*a*).

Both propellant powders are fired in the 150 $cm^3$ pressure bomb at −40° C., +21° C. and +63° C. The results are shown in FIG. 10. Even though the moderator deposited on the propellant powder is not cross-linked, a vivacity change cannot be detected in the pressure bomb before (FIG. 10*a*)

and after (FIG. 10*b*) the aging process. It means that the moderator is not diffused away from or into the propellant powder.

The analysis of the concentration profiles with FTIR microspectroscopy, carried out before and after the aging of the propellant powder, also does not show any changes.

EXAMPLE 9

(L17MM2007/TV50

With this example, the effect according to the invention is reached without deterrent.

A medium-size rotation drum is filled with 55 kg untreated grain, produced with a matrix of 12.0×(19×0.20) mm. The untreated grain was preheated to 30° C.

Added to the heated, untreated grain inside the drum rotating at 13.5 rpm are 42 g graphite (0.075 weight % relative to the propellant powder) and 55 g talcum (0.10%). As soon as the graphite and the talcum are distributed homogeneously over the propellant powder, 695 g solvent (ethanol:water, 3:1; 15 ml per kg of untreated grain) are added and the mixture is then rotated inside the closed drum for 60 minutes at 30° C.

Following this, the closing lid is removed and the solvent allowed to evaporate from the rotating drum during a period of 30 minutes.

The treated propellant powder is dried for 3 days at 60° C.

FIG. 11*a* (untreated grain) and FIG. 11*b* (following the treatment according to the invention) show the pressure-bomb firings at different propellant powder temperatures of the untreated grain (untreated) and the treated grain (following storage at 21° C. for 4 weeks). The pressure bomb clearly shows the reduction in the temperature dependence of the propellant powder burning following the surface treatment.

In summary, the following must be noted here:

The present invention resulted in the new finding that lowering the temperature coefficient of perforated double-base to multi-base propellant powders is achieved through a purposeful sealing of the perforations with plugs, which have a temperature-dependent mobility. Suitable surface-treatment processes can be used to close off the holes in the propellant powder, such that the hole burning is delayed at high propellant powder temperatures, but occurs immediately at low temperatures (influence on the form function). This leads to a burning behavior of the surface-treated double-base propellant powder, which is for the most part independent of the propellant powder temperature.

Surprisingly, it was found that with an optimum selection of the treatment components and parameters and minimum amounts of treatment means, a temperature-independent burning of the homogeneous, treated propellant powder can be achieved. The great advantage of this is that the treated propellant grain can be ignited easily with the initial ignition. In addition, the surface treatment according to the invention can be reproduced in such a way that the treated propellant powder can be used in the pure form (and not necessarily as a mixture). Thus, a homogeneous combustion can be achieved.

Surprisingly enough, it was also discovered that the surface treatment according to the invention permits the production of ballistically stable propellant powders. A uniform burning is thus ensured over the complete deployment period for the ammunition system.

These new types of surface treatments in principle can be used for any perforated untreated grain, but must be adapted to the individual formulation and matrix of the propellant powder as well as the ignition system, so that the temperature dependence of the propellant powder burning can be optimally adjusted.

The surface treatment technique that was discovered makes it possible to produce propellant powders with similarly high gas-formation rates and thus similar muzzle velocities and peak gas pressures over a broad temperature range. As a result, a constant high energy level is available, independent of the environmental temperature at which the ammunition is fired, and the final ballistic performance can thus be kept constant and high.

With the treatment according to the invention, the temperature behavior of the propellant powder can be varied over a wide application range, or a desired behavior can specifically be adjusted. If a weakened form of the surface treatment is realized (smaller amounts of solid material and/or moderator (deterrent) and/or shorter treatment times than for the optimum treatment), a reduced temperature dependence of the propellant powder burning is achieved. With an optimum treatment, however, the propellant powder burning is nearly independent of the temperature. If a more intense surface treatment is realized (larger amounts of solid material and/or moderator (deterrent) and/or longer treatment times than for the optimum treatment), the temperature behavior of the propellant powder can be inverted. In that case, the gas-formation rate of the treated propellant powder is lower at high temperatures than at low temperatures.

Thus, a propellant powder with temperature-independent burning can also be produced when mixing a highly treated and a non-treated propellant powder at the right ratio.

The treated bulk powder has improved pourability and increased bulk density. The bulk density is a measure for the propellant powder weight that can be inserted into a volume unit and is typically provided as gram per liter (g/l). This increased bulk density is of high importance since the casing volume of a given ammunition component is predetermined. The higher the amount of propellant powder that can be inserted into a predetermined casing volume, the more chemical energy is available for the ballistic deployment.

Since only extremely small amounts of energetic inert material are used for the new type of surface treatment, the performance drop of the treated propellant powder hardly matters (based on the combustion calorimetry, the treated propellant powder only has approximately 2% less explosion heat as compared to the untreated grain).

In particular the excellent deployment service life must be stressed. Storing the propellant powder over long periods of time or at high temperatures is possible without essential changes to the burning characteristic.

In contrast to prior art, the tendency to brittle fractures or the development of cross burners during low temperatures is not favored with the surface treatment according to the invention.

A temperature-independent burning inside the pressure bomb or in the weapon can be achieved by using the smallest possible amounts of treatment means, without this worsening the ignition behavior.

The treatment process is simple, reproducible and relatively cheap.

The invention claimed is:

1. A propellant, comprising at least one grain and a plug, wherein said at least one grain has a diameter of at least 3 mm and has at least one hollow chamber that discharges with an opening to an outside surface of the grain, wherein the opening has a diameter of 0.03 mm to 0.5 mm and is closed off with said plug, wherein the plug comprises a non-volatile solid material and a moderator wherein the plug is formed, in a polishing drum, in which the grain is subjected to surface treatment in combination with an amount of solid material of 0.085 to 0.4 wt % relative to the weight of the grain and an amount of moderator of 0.05–0.5 wt % relative to the weight of the grain;

wherein the plug has a temperature dependent mobility, meaning it has a higher mobility for a lower deployment temperature than for a higher deployment temperature, so that the plug permits a stronger hole burning at a lower deployment temperature than at a higher deployment temperature.

2. A propellant according to claim 1, characterized in that the plug consists of a substance that is not soluble in an untreated grain upon which the treated grain is based.

3. A propellant according to claim 1, characterized in that the plug comprises an inert solid material having a grain size in the range of 0.01 to 100 micrometers.

4. A propellant according to claim 1, characterized in that the inert non-volatile solid material of the plug is selected from the group consisting of graphite, talcum, titanium oxide, carbon black, potassium sulfate, potassium cryolite, wolfram trioxide and calcium carbonate.

5. A propellant according to claim 1, characterized in that the plug contains a small amount of energetic solid material, in particular nitrocellulose, hexogen and the like.

6. A propellant according to claim 1, characterized in that the plug has a melting temperature above 90° C.

7. A propellant according to claim 1, characterized in that the grain is provided with at least several axial through holes providing the hollow chamber and that the hollow chamber closed off by the plugs has a hollow chamber volume, which is a multiple of a plug volume.

8. A propellant according to claim 6, characterized in that the grain is cylindrical and has a diameter of a maximum of 20 mm, and holes which have a diameter of 0.1 to 0.3 mm.

9. A propellant according to claim 1, characterized in that the grain is a double-base or multi-base grain.

10. A propellant according to claim 1, characterized in that the non-volatile material of the plug has a grain size in the range of 0.1 to 50 micrometers.

11. A propellant according to claim 1, characterized in that the grain is provided with 7 to 19, axial through holes and that the hollow chamber closed off by the plugs has a hollow chamber volume, which is a multiple of a plug volume.

12. A propellant having grains with at least one hollow chamber that discharges with an opening to an outside surface of the grain, wherein the opening is closed off with a plug, characterized in that the plug mainly consists of a non-volatile solid material wherein the plug is the result of a surface treatment of the grain inside a polishing drum in combination with an amount of solid material of 0.075 to 0.4 wt-%[1] relative to the weight of the grain[2] and an amount of moderator of 0.05 to 0.5 wt %[3] relative to the weight of the grain for stabilizing the plug and wherein the plug has a temperature dependent mobility—characterized by the fact that the mobility of the plug is higher for a lower deployment temperature than for a higher deployment temperature, so that the plug permits a stronger hole burning at a lower deployment temperature than at a higher deployment temperature.

13. In a propellant powder which exhibits temperature dependent burning, the improvement comprising a propellant which burns substantially independent of propellant powder temperature and comprises at least one perforated grain and at least one plug;

wherein said at least one grain has a diameter of at least 3 mm and has at least one hollow chamber that discharges with an opening to an outside surface of the grain, wherein the opening has a diameter of 0.03 mm to 0.5 mm and is closed off with said plug, wherein the plug comprises a non-volatile solid material and a moderator wherein the plug is formed by a treatment of said grain with a composition comprising about 0.085 to 0.4 wt %, relative to the weight of the grain, of said solid material and about 0.05–0.5 wt % relative to the weight of the grain, of said moderator, wherein the moderator is in liquid form.

14. The powder of claim 13, wherein the moderator is solid or liquid and wherein solid moderator is dissolved in a solvent therefor.

15. The propellant powder of claim 13, characterized in that solid material is selected from the group consisting of graphite, talcum, titanium oxide, carbon black, potassium sulfate, potassium cryolite, calcium carbonate, and wolfram trioxide; and moderator is selected from the group consisting of polytetrahydrofuran, polyvinyl alcohol, poly(vinylalcohol-co-vinylacetate), poly(vinylalcohol-co-ethylene), polybutadienediol, polybutadienediol dimethacrylate, and poly(α-methylstyrene), polybutadiene or polybutadienediol diacrylate.

16. The propellant powder of claim 13, characterized in that liquid is selected from the group consisting of water, ethanol, hexane, cyclohexane and a mixture of water/ethanol, water/methanol or water/acetone.

17. The propellant powder of claim 1, wherein the plug comprises graphite.

18. The propellant powder of claim 1, wherein the grain comprises nitrocellulose.

19. The propellant powder of claim 1, wherein the moderator comprises polytetrahydrofuran.

20. The propellant powder of claim 17, wherein the grain comprises nitrocellulose.

21. The propellant powder of claim 20, wherein the moderator comprises polytetrahydrofuran.

* * * * *